US012404696B2

(12) United States Patent
Grace et al.

(10) Patent No.: US 12,404,696 B2
(45) Date of Patent: Sep. 2, 2025

(54) PORTABLE AND COLLAPSIBLE CANOPY STRUCTURE

(71) Applicant: GCI Outdoor LLC, Higganum, CT (US)

(72) Inventors: Daniel R. Grace, Old Saybrook, CT (US); Bruce Agli, East Hampton, CT (US); Paul T. Crotty, Waterford, CT (US)

(73) Assignee: GCI Outdoor LLC, Higganum, CT (US)

( * ) Notice: Subject to any disclaimer, the term of this patent is extended or adjusted under 35 U.S.C. 154(b) by 193 days.

(21) Appl. No.: 18/208,552

(22) Filed: Jun. 12, 2023

(65) Prior Publication Data

US 2023/0399869 A1 Dec. 14, 2023

Related U.S. Application Data

(60) Provisional application No. 63/351,011, filed on Jun. 10, 2022.

(51) Int. Cl.
*E04H 15/50* (2006.01)

(52) U.S. Cl.
CPC ..... *E04H 15/50* (2013.01)

(58) Field of Classification Search
None
See application file for complete search history.

(56) References Cited

U.S. PATENT DOCUMENTS 923,021 A 5/1909 Condon
6,598,614 B2 * 7/2003 Liu ..... E04H 15/50 135/131
6,868,858 B2 * 3/2005 Suh ..... E04H 15/48 135/145
6,874,520 B2 4/2005 Carter
7,845,365 B2 12/2010 Carter
(Continued)

FOREIGN PATENT DOCUMENTS

KR 20080002408 U * 7/2008

OTHER PUBLICATIONS

PCT Application No. PCT/US2023/06898 International Search Report and Written Opinion, dated Sep. 27, 2023.

*Primary Examiner* — David R Dunn
*Assistant Examiner* — Danielle Jackson
(74) *Attorney, Agent, or Firm* — Lathrop GPM LLP; Wm. Tucker Griffith

(57) ABSTRACT

A portable and collapsible canopy structure, capable of being set-up and locked in a set-up condition, and likewise unlocked and collapsed from the set-up condition to a collapsed condition for transportation and storage, comprises a lever system allowing for single-user operation for set-up and break-down, wherein the user remains outside the unit, preferably at a single corner of the canopy frame. Further, the lever system provides means for locking the frame in the set-up condition for safe use, and likewise unlocking the frame for collapsing the canopy structure for transport and storage. More particularly, a lever member engages with a rib linkage associated with one corner of the frame to extend said rib linkage to an extended condition, the extension of which coordinates simultaneous extension of the other rib linkages, as well as extension of horizontal supports connected between the corners of the canopy frame.

14 Claims, 21 Drawing Sheets

(56) References Cited

U.S. PATENT DOCUMENTS

| | | | | |
|---|---|---|---|---|
| 8,590,553 | B2 * | 11/2013 | Lovley, II | E04H 15/50 135/120.2 |
| 9,995,056 | B2 * | 6/2018 | Yang | E04H 15/50 |
| 10,246,898 | B2 * | 4/2019 | Jin | E04H 15/46 |
| 10,407,940 | B2 * | 9/2019 | Ferrari | E04H 15/32 |
| 10,669,738 | B2 | 6/2020 | Yang et al. | |
| 11,230,858 | B2 | 1/2022 | Yuan et al. | |
| 12,104,398 | B2 * | 10/2024 | Sun | E04H 15/46 |
| 2004/0084074 | A1 * | 5/2004 | Chiu | E04H 15/50 135/131 |
| 2004/0216419 | A1 * | 11/2004 | Sy-Facunda | E04H 15/50 52/745.15 |
| 2007/0012347 | A1 | 1/2007 | Ochi | |
| 2011/0061702 | A1 | 3/2011 | Lin | |
| 2014/0130837 | A1 * | 5/2014 | Sy-Facunda | E04H 15/50 135/120.3 |
| 2018/0010360 | A1 | 1/2018 | Lovley, II et al. | |

* cited by examiner

PORTABLE AND COLLAPSIBLE CANOPY STRUCTURE

CROSS-REFERENCE TO RELATED APPLICATION

This application claims the benefit of U.S. Provisional Application Ser. No. 63/351,011, filed Jun. 10, 2022, which is incorporated herein by reference in its entirety.

FIELD OF THE INVENTION

The present invention generally relates to canopy structures and collapsible support structures, and more particularly relates to improvements in a portable and collapsible canopy structure that is foldable and unfoldable between a set-up condition for use and a substantially collapsed condition for transportation and/or storage, and even more particularly, relates to a lever system facilitating set-up and break-down of the canopy structure.

BACKGROUND OF THE INVENTION

Popularity of the minivan, the sport utility vehicle and the recreational vehicle has resulted in increased demand for improved collapsible furniture and particularly collapsible portable furniture of the outdoor type which may be readily stowed in a vehicle and conveniently manually transported to a beach, a picnic area or the site of a spectator event, such as, for example, an outdoor concert, a sporting event, a tailgate, a golf tournament, an air show, or a flea market, where the general rule is to bring and set-up your own accommodations.

Considerable attention has been directed to the provision of improved collapsible furniture for the picnicker, beach-goer, sportsman, tailgater, camper, hunter, fisherman, hiker, biker and the like. Canopy structures and portable tent canopy structures have become popular because of designs with increased collapsibility and transportability. Notably, canopy structures of 8×8, 10×10 and 12×12 footprints have become popular for a variety of uses in a variety of locations, including at the beach, park, campsites, sporting fields, parking lots, tailgates and the like, where the canopy structure can be set-up for use, but also collapsed to a bundled condition suitable for transport in the user's car or truck without occupying too much storage space.

In traditional prior art embodiments such as illustrated in FIGS. 1-3, a canopy structure 10 generally comprises a top fabric cover 12 configured to cover a frame 14 comprising a plurality of vertical support members 16 interconnected by a plurality of horizontal support members 18, with a plurality of rib linkages 20 connected between the vertical support members 16 to define a central peak 22 for the cover 12 of the canopy structure 10. In such a prior art canopy structure 10, the support members 16, 18 and rib linkages 20 are generally pivotally interconnected so that the structure 10 can be readily collapsed to a bundled condition for transport and storage. Optimally, the collapsed canopy structure will occupy the smallest volume without compromising the set-up area of the canopy structure. In this regard, such structures generally use telescoping vertical support members 16 that can readily be extended to increase the height of the set-up canopy structure 10. Additionally, the horizontal support members 18 and the rib linkages 20 commonly utilize pivotally connected elongated members that pivot out to an extended length to maximize set-up size while maintaining a minimal collapsed size. For example, as illustrated in FIG. 2, the horizontal support members 18 commonly use scissors-style X-member linkages to facilitate the set-up and collapsing capabilities of the frame 14. In such a design, elongated members are pivotally connected at an intermediate location to form an individual X, and then pivotally linked at the terminal portions of each elongated member with the elongated members of one or more additional Xs to create a linkage that will form the horizontal support member 18. Each linkage can move between an extended condition and a collapsed condition. In the extended condition, the connected Xs are extended in series to maximum length for the horizontal support member 18 or rib linkage 20. In the collapsed condition, the connected Xs are pivoted together to all be generally adjacent and parallelly disposed relative to one another. Utilizing multiple connected X-frames can increase the set-up length and overall footprint of the frame 14 while allowing for a more compact bundle when the frame 14 is collapsed. FIG. 3 illustrates a collapsed bundle for the canopy structure 10 illustrated in FIGS. 1-2.

The difficulty with such canopy structures has generally come from the set-up and collapsing functionality. Traditional canopy structures have been difficult for one person to set-up by themselves in a time efficient manner, especially as the size of the canopy structure increases. For example, when setting up the canopy structure from the bundled condition, the user must spread out the four vertical supports or legs (at each corner of the canopy) to extend the scissors-style X-members of the horizontal members and the rib linkages from their collapsed condition, where all the constituent members are adjacently collected, to their extended condition, where said constituent members are spread out end to end to define and maximize the length for the member linkage. As a result, a user setting up the canopy structure will need to go from corner to corner, often many times, to spread out the structure until each horizontal support member and rib linkage is at its full extended condition. Typically, the extension of the horizontal support members and the rib linkages go hand-in-hand. That is, as the horizontal support members are extending, the rib linkages will likewise be moving to their respective extended conditions, and vice versa. Moreover, the horizontal support members do collectively move as well, in that, when pulling out each of the corner vertical support members from each other, each of the horizontal support members will collectively stretch out to their extended conditions. The rib linkages likewise move in a collective manner, in that, when extending one rib linkage, the others will extend at the same rate. Nevertheless, this action is cumbersome and can be quite time-consuming, especially for one user.

The set-up process also involves locking the frame once it is fully set-up. Otherwise, the horizontal support members and rib linkages can easily start to collapse on their own under the influence of gravity, especially if the vertical support members (i.e., the corners of the canopy structure) are not sufficiently secured on the ground surface on which the canopy structure is set-up, or if there is a heavy wind pushing on the frame and canopy cover that can caused the frame members to collapse on their own. The horizontal support members and rib linkages can also start to collapse if objects are hung from the frame, such as towels, lanterns or other weighted objects. In this regard, traditional prior art canopy structures have utilized locks on each of the vertical support members at each corner to lock the horizontal support members in their extended conditions until the lock is released. For example, such designs have utilized spring-biased push buttons in each corner that lock into place (e.g., project through a detent or hole in the vertical support members) when the horizontal support members are in their fully extended condition. However, this design further adds to the difficulty in the set-up and break-down of the canopy structure. For example, during set-up of the canopy structure, the user must go to each corner separately to ensure that each push button is properly engaged to lock the frame at that corner location. To collapse the canopy structure, the user must release each push-button to begin collapsing the horizontal support members to their collapsed conditions. Again, however, each individual button, in each separate corner must be engaged and released separately, which requires the user to walk to each corner to fully set-up and collapse the prior art canopy structure. In general, this design is best for multiple people to work together to set-up and collapse the canopy structure. While a single person can achieve both set-up and collapse of the structure, it is difficult, time-consuming and requires some exertion of effort.

The current market-leading canopy technology no longer involves the four-corner buttons. For example, a prior art design for a canopy structure has evolved to a one-person, one-location setup using a "one-push" center hub lock. This center hub lock is located in the center of the canopy structure, generally where the four rib linkages extending inward from each corner of the structure meet. By pressing up on the center hub, the rib linkages will be locked into their extended over-center condition, which, as noted, coincides with the fully extended condition of each of the horizontal support members. Thus, with the rib linkages locked in this extended condition, the corners of the canopy structure cannot be pushed together to collapse the structure until the center lock is released. Disengaging the center hub lock allows the frame to be collapsed. Indeed, once the center hub lock is released, the entire frame begins to collapse under the influence of gravity. This design provides a significant upgrade from the four-corner button approach—facilitating one-person set-up and collapse—but still has a distinct disadvantage of requiring the user to crawl under and inside the canopy to push up and lock the frame in its set-up condition. The same disadvantage applies to closing the canopy wherein the user must be under the canopy to disengage the center hub lock. In this regard, the entire canopy can collapse on the user at it begins to collapse under the influence of gravity. Additionally, this approach does not provide for a convenient or comfortable usage, often requiring the user to crawl on the ground to get in and out from under the canopy, which is especially difficult and undesirable on wet ground. Additionally, set-up of this canopy design still requires the user to move from corner to corner to extend the frame from its collapsed condition and ensure that each horizontal support member and each rib linkage is extended to its full extent before locking the frame in the set-up condition.

In view of the foregoing, there is a need for a canopy structure that can be easily set-up and collapsed, especially by a single user, without requiring the user to lock in each corner of the canopy frame individually or climb under the canopy frame during set-up or collapse. Further, there is a need for such a canopy structure that can be set-up and locked and then unlocked and collapsed with minimal effort, again especially by a single user, without limiting or compromising the structural features of the canopy structure. Further, there is a need for a canopy structure that can optimally be set-up and collapsed from a single spot, and that doesn't require a user to go from corner to corner to extend or collapse the frame of the canopy structure. Still further, there is a need for a canopy structure that can be easily set-up without compromising or affecting the safety and structural integrity of the canopy structure, especially on all types of surfaces, including soft ground and sand. Accordingly, it is a general object of the present invention to provide a portable and collapsible canopy structure that overcomes the problems and drawbacks associated with prior art canopy structures, and therefore significantly improves the utility of such a canopy while permitting easy transportation and/or storage in a collapsed condition.

The present invention addresses these issues and provides a means to circumvent the associated drawbacks of such prior art collapsible canopy structure designs.

SUMMARY OF THE INVENTION

The present invention is directed to a portable and collapsible canopy structure design especially suitable for use at a beach, park, tailgate, sporting event and the like, where the canopy structure can be set-up to a set-up condition, and locked in said set-up condition, and likewise unlocked and collapsed from the set-up condition to a collapsed condition for transportation and/or storage by a single user from a single location. The present invention improves upon the four-corner buttons approach and the one-push center hub technology of the prior art by providing a lever system for a canopy structure allowing for single-user operation for set-up and break-down, wherein the user remains comfortably standing outside the unit, preferably at a single corner of the canopy frame, thus avoiding the crawl in-and-out headache (especially with bad knees, wet ground, etc.). Still further, the lever system of the present invention provides a means for locking the frame in the set-up condition for safe use, and likewise unlocking the frame for collapsing the canopy structure for transport and/or storage.

The lever system of the present invention can be utilized on the traditional canopy frame set-up—namely, a frame having four vertical supports at each corner connected by scissors-style horizontal supports adapted to move between extended and collapsed conditions. The frame further includes four rib linkages each extending inwardly from a respective corner vertical member and connected one to each other at a central hub defining a central peak for the canopy structure. A top fabric cover, configured to cover the frame, is also provided and designed to remain on the frame during set-up and collapse of the canopy structure. It is understood that "cover the frame" encompasses designs that are configured to "at least partially cover the frame assembly," such that the top of the canopy is covered while the sides of the frame are open for people to walk under and out from the canopy. However, the present invention also covers canopy designs where a cover encompasses the entirety of the frame, for example, providing walls to protect the user from the elements (such as wind and sun) as desired.

In this regard, in an embodiment of the present invention, a portable and collapsible canopy structure comprises a frame assembly being movable between a set-up condition and a collapsed condition; a fabric cover, configured to cover at least a portion of the frame assembly; and a lever member operatively connected to the frame assembly for assisting a user in moving the frame assembly to its set-up condition and locking the frame assembly once in said set-up condition. In preferred embodiments, the lever member facilitates set-up of the canopy structure, locks the canopy structure in its set-up condition, unlock the canopy structure from its locked condition, and assists in break-down of the canopy structure to its collapsed condition. More preferably, a single user can accomplish each of these actions from a single position outside the footprint of the canopy structure and need not go under the canopy for set-up or break-down.

In another embodiment of the present invention, a portable and collapsible canopy structure comprises a frame assembly being movable between a set-up condition and a collapsed condition, and a fabric cover, configured to cover at least a portion of the frame assembly. The frame assembly comprises a plurality of vertical supports defining a perimeter for the frame assembly in the set-up condition; a plurality of scissoring horizontal supports each pivotally connected to and extending between an adjacent pair of vertical supports around the perimeter of the frame assembly and adapted for movement between an extended condition corresponding to the set-up condition of the frame assembly and a retracted condition corresponding to the collapsed condition of the frame assembly; and a plurality of rib linkages, each pivotally connected to a respective vertical support and extending from said vertical support towards a central hub where the plurality of rib linkages meet, each said rib linkage being adapted for movement between an extended condition corresponding to the set-up condition of the frame assembly and a retracted condition corresponding to the collapsed condition of the frame assembly. The canopy structure further includes a lever member pivotally connected to one of the plurality of rib linkages for facilitating movement of said rib linkage between the extended and retracted conditions.

In accordance with preferred embodiments of the present invention, a locking lever member is positioned at one corner of the canopy structure and engages with a rib linkage associated with that corner of the frame to extend said rib linkage to an extended condition. The extension of the rib linkage coordinates extension of the other rib linkages at the same time, as well as extension of the horizontal supports to respective extended conditions between the corners of the canopy frame. When the rib linkage is at its full extended condition, the other rib linkages are likewise at their full extended conditions, and a center hub connecting the rib linkages together is moved into over-center condition to lock the frame in the set-up condition. Likewise, the locking lever member is used to disengage the center hub from its over-center condition to unlock the frame and facilitate collapsing of the frame under the influence of gravity.

In preferred embodiments, the rib linkage associated with the lever member comprises a first upright arm pivotally connected to the vertical support associated with said rib linkage; a second upright arm pivotally connected to the first upright arm, wherein a center hub cap is mounted at a distal end of said second upright arm; a first lift tube pivotally connected to the first upright arm; a second lift tube pivotally connected to the first lift tube and to the second upright arm; and a center support tube pivotally connected between the second upright arm and the second lift tube, wherein a center hub support is mounted at a distal end of said center support tube. The lever member is pivotally connected to the rib linkage such that pivoting movement of the lever member influences movement of the first upright arm and first lift tube, which influences movement of the second upright arm and second lift tube, which influences movement of the center support tube, all of which move the center hub cap and the center hub support between an engaged condition corresponding to the set-up condition of the canopy frame assembly and a disengaged condition whereby the frame assembly can be moved to its collapsed condition.

In another embodiment of the present invention, a portable and collapsible canopy frame adapted for movement between a set-up condition and a collapsed condition comprises a plurality of vertical supports defining a perimeter for the frame assembly in the set-up condition; a plurality of rib linkages, each pivotally connected to a respective vertical support and extending from said vertical support towards a central hub where the plurality of rib linkages meet, each said rib linkage being adapted for movement between an extended condition corresponding to the set-up condition of the frame assembly and a retracted condition corresponding to the collapsed condition of the frame assembly; and a lever member operatively connected to one of the plurality of rib linkages for assisting a user in moving the frame assembly to its set-up condition and locking the frame assembly once in said set-up condition. In use, a user can access and use the lever member to assist with set-up and collapsing of the canopy structure from a position outside the canopy frame.

These and other features of the present invention are described with reference to the drawings of preferred embodiments of a portable and collapsible canopy structure. The illustrated embodiments of features of the present invention are intended to illustrate, but not limit the invention.

DETAILED DESCRIPTION OF EMBODIMENTS OF THE INVENTION

Figure 1:
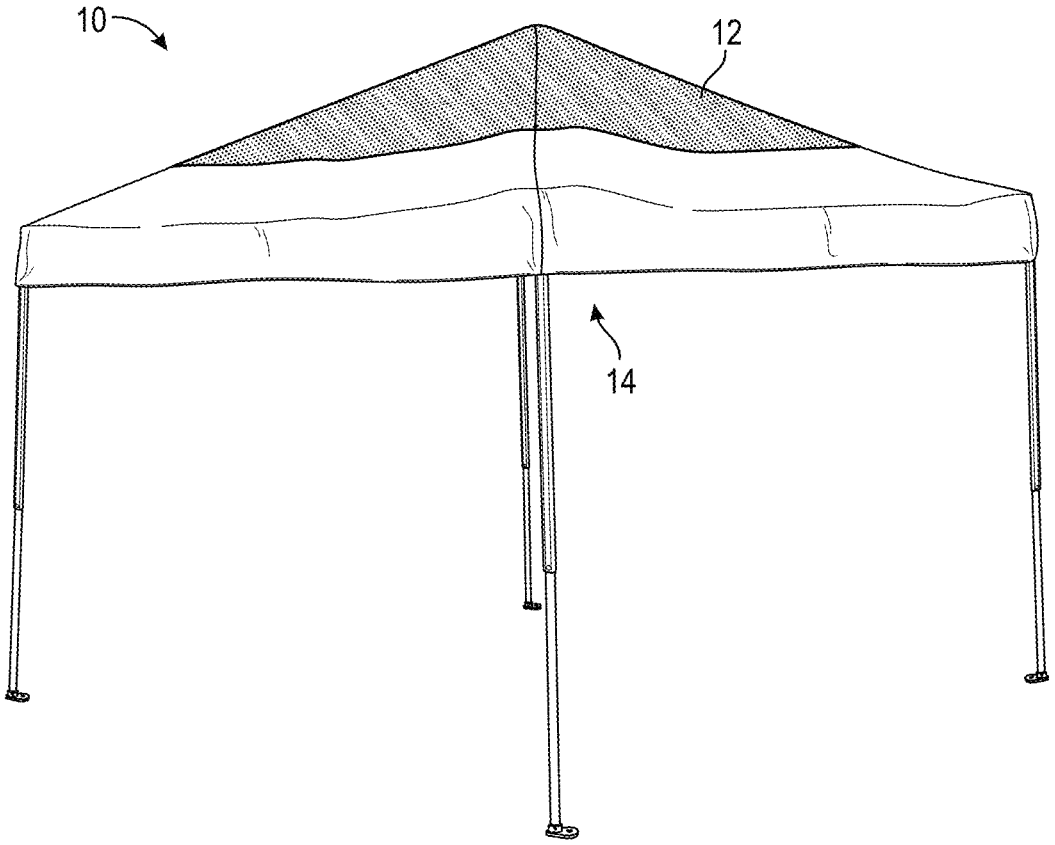
FIG. 1 (PRIOR ART)
FIG. 1 is a perspective view of a prior art portable and collapsible canopy structure in a set-up condition of said canopy structure.

A portable and collapsible canopy structure design in accordance with a first embodiment of the present invention is illustrated in FIGS. 4-10 and generally designated as reference numeral 100. The canopy structure is especially suitable for use at a beach, park, tailgate, sporting event and the like, where the canopy structure 100 can be set-up to a set-up condition, and locked in said set-up condition, and likewise unlocked and collapsed from the set-up condition to a collapsed condition for transportation and/or storage by a single user from a single location.

The figures illustrate a portion of a canopy frame 114—more particularly, including a lever system for the canopy structure 100 allowing for single-user operation for set-up and break-down, wherein the user remains comfortably standing outside the unit, preferably at a single corner of the canopy frame 114, thus avoiding the crawl in-and-out headache associated with prior art canopy designs (especially with bad knees, wet ground, etc.). The lever system interacts with a rib linkage 120 extending from a vertical support 116 at one corner of the canopy frame 114. The rib linkage 120 comprises interconnected longitudinal members extending to a center hub 122 connecting all the rib linkages 120 of the entire frame 114 together at a central location of the canopy structure 100.

Figure 2:
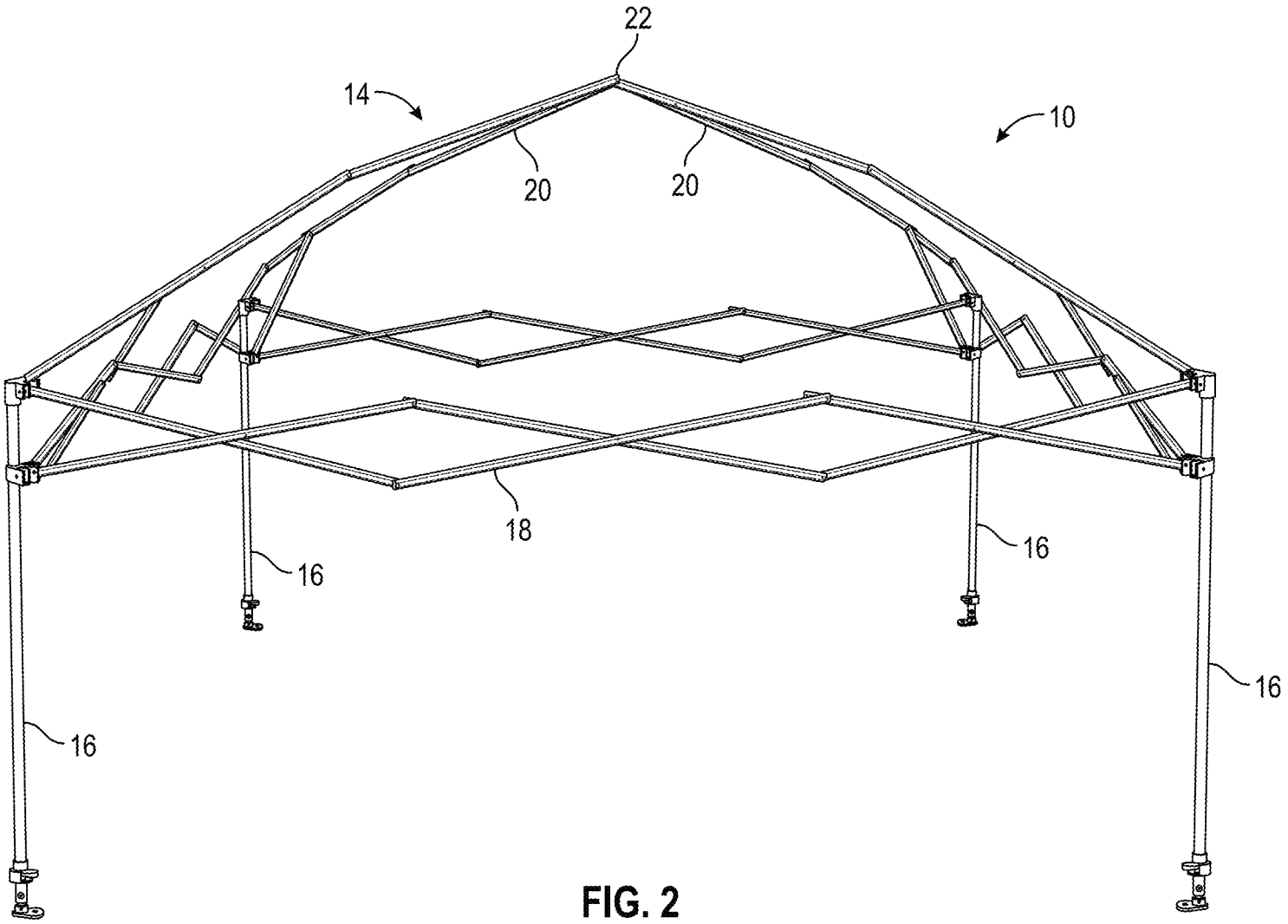
FIG. 2 (PRIOR ART)
FIG. 2 is a perspective view of a frame for the prior art canopy structure of FIG. 1 in a set-up condition of said canopy structure with the cover fabric removed.
Figure 3:
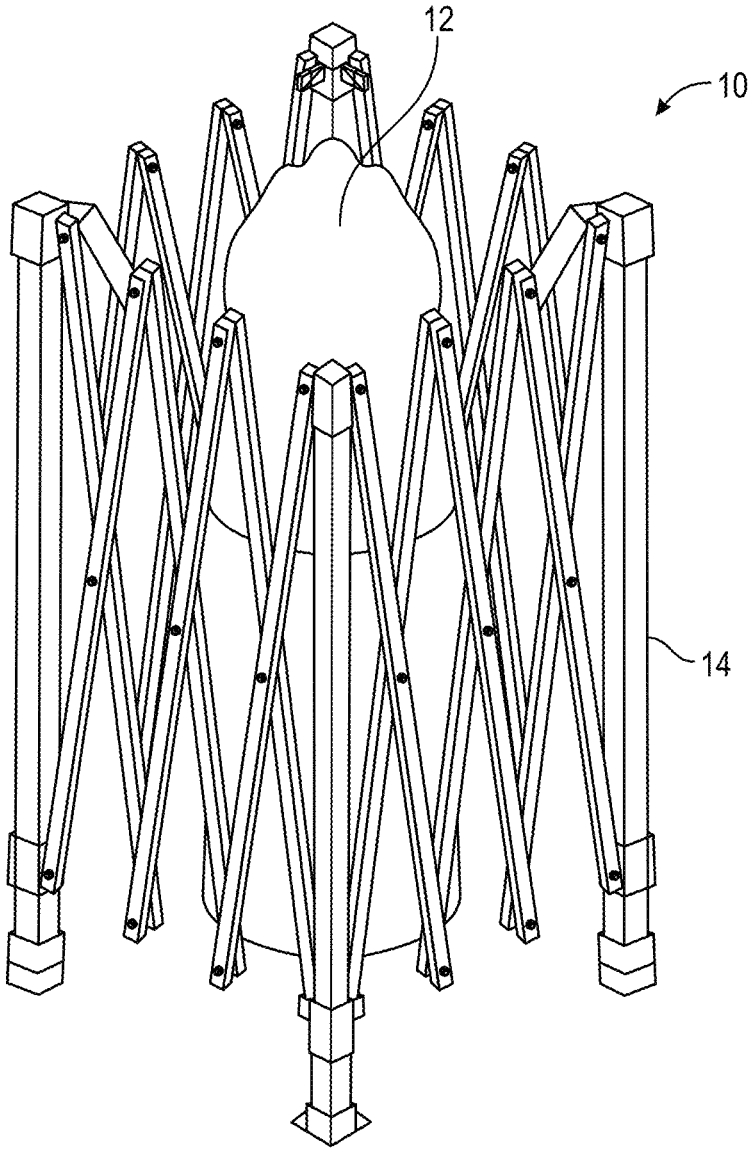
FIG. 3 (PRIOR ART)
FIG. 3 is a perspective view of the prior art canopy structure of FIG. 1 in a collapsed and bundled condition for transport and/or storage.

The lever system of the present invention can be utilized on and with the traditional canopy frame set-up, such as illustrated in FIG. 2—namely, a frame 114 having four vertical supports 116 at each corner connected by scissors-style horizontal supports 118 adapted to move between extended and collapsed conditions. The frame 114 further includes four rib linkages 120 each extending inwardly from a respective corner vertical support 116 and connected one to each other at the center hub 122 defining a central peak for the canopy structure 100. A top fabric cover, configured to cover the frame 114, is also provided and designed to remain on the frame 114 during set-up and collapse of the canopy structure 100. It is understood that "cover the frame" encompasses design that are configured to "at least partially cover the frame assembly," such that the top of the canopy is covered while the sides of the frame are open for people to walk under and out from the canopy. However, the present invention also covers canopy designs where a cover encompasses the entirety of the frame, for example, providing walls to protect the user from the elements (such as wind and sun) as desired.

As illustrated, the lever system interacts with the rib linkage 120 at one corner of the frame 114 such that a single user can set-up the frame 114 by extending the single rib linkage 120, which coordinates simultaneous movement of the other rib linkages, as well as the horizontal supports 118 extending between the vertical supports 116 at each corner of the canopy frame 114. The user can likewise lock the frame 114 in its set-up condition using the lever system, and thereafter, unlock the frame 114 for collapsing under the influence of gravity. Again, the set-up, locking, unlocking, and collapsing action for the canopy structure 100 can all be accomplished by a single user from a single location (e.g., at one corner of the canopy structure 100).

The present design (playfully called "LevrUP") surpasses the one-push technology of prior art canopy structures in that while it is also a single-user operation, the user remains comfortably standing outside the canopy structure, thus avoiding the crawl in-and-out headache (especially with bad knees, wet ground, etc.) or the dangers of being under the canopy when it is collapsing, as generally associated with prior art canopy designs.

As noted, the lever system of the present invention provides a means for locking the frame 114 in the set-up condition for safe use, and likewise unlocking the frame 114 for collapsing the canopy structure for transport and/or storage.

Figure 4:
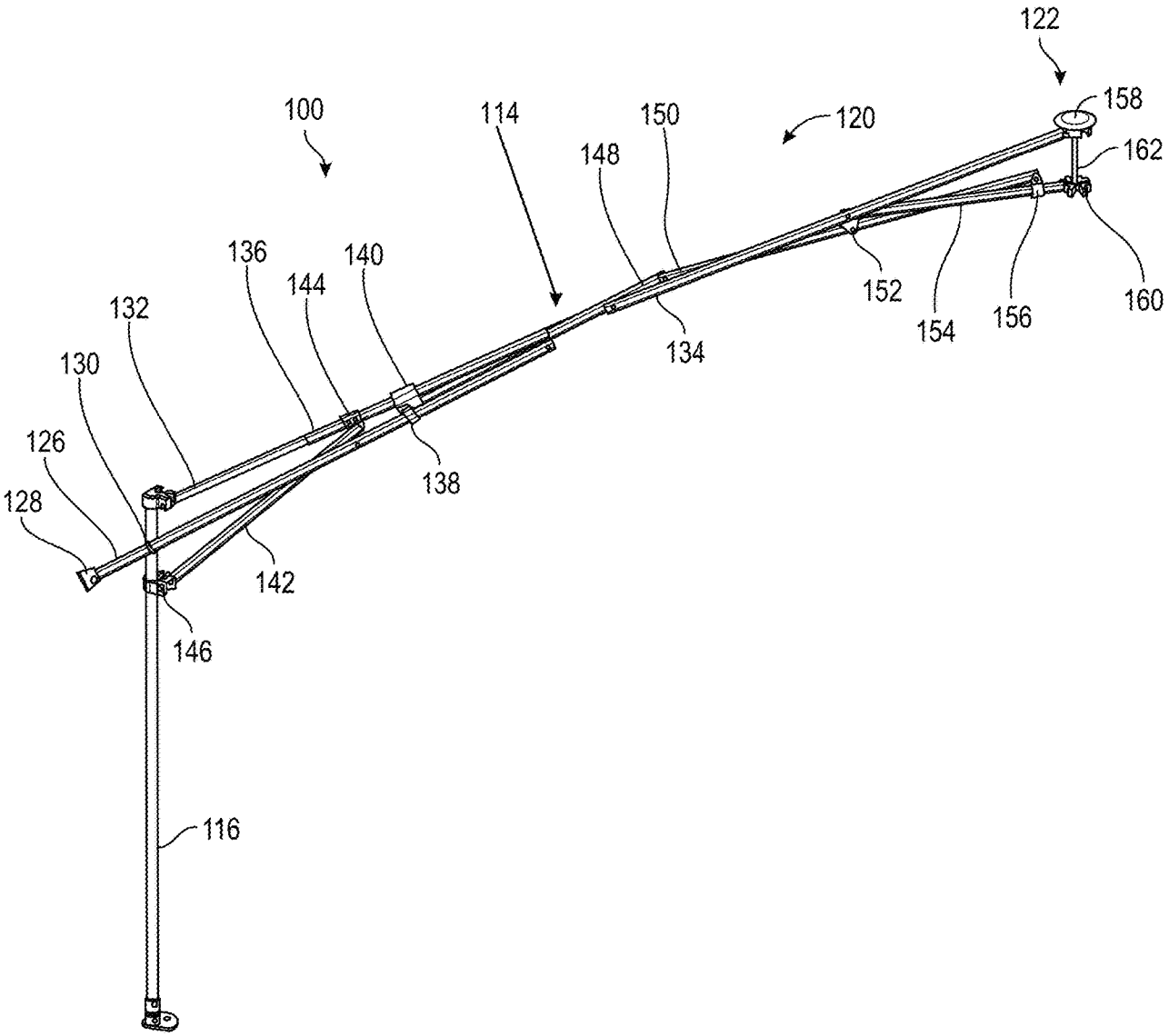
FIG. 4 is a partial perspective view of a rib linkage and vertical support at one corner of a canopy structure with a locking lever member in accordance with a first embodiment of the present invention, with the rib linkage at a fully extended condition.
Figure 5:
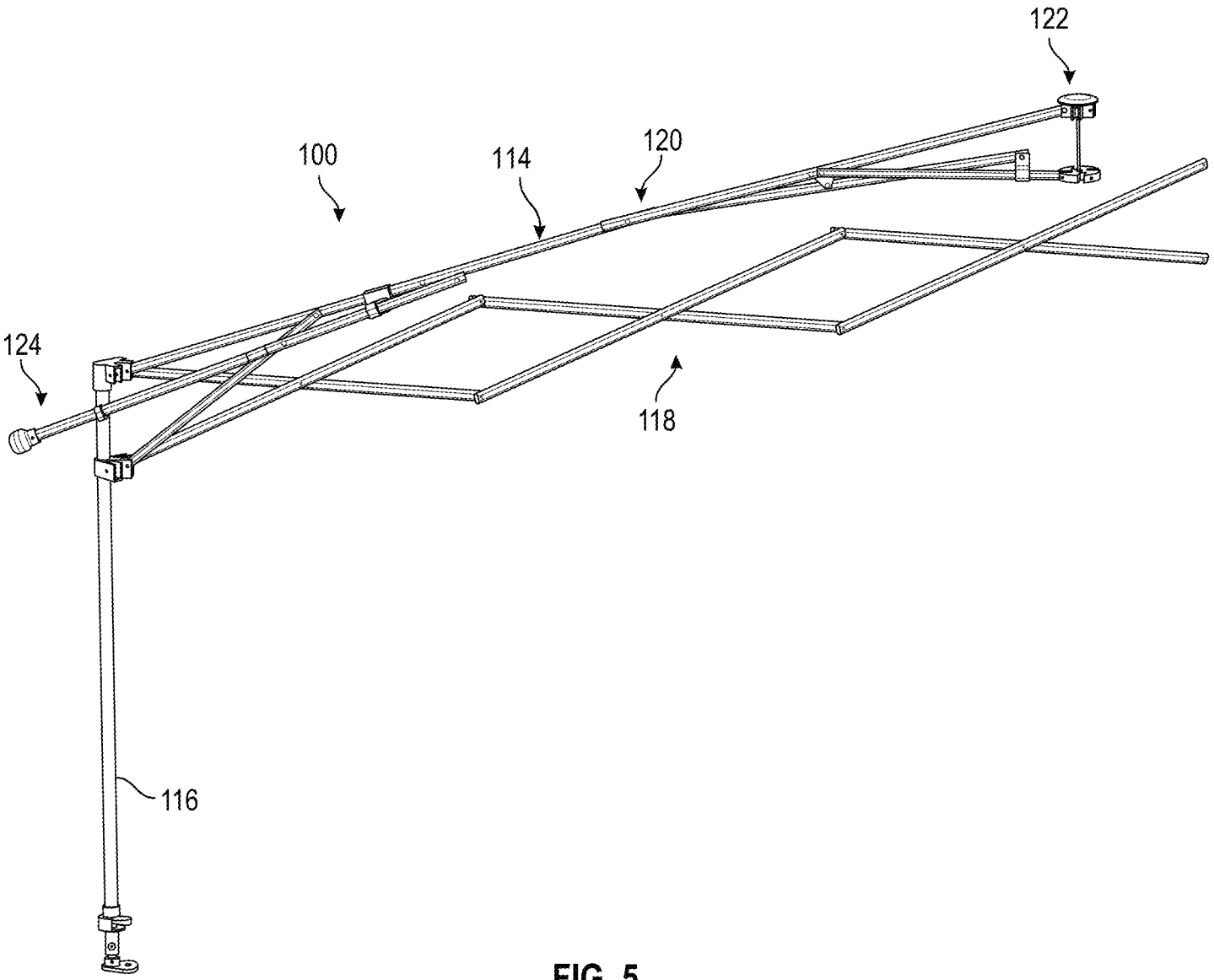
FIG. 5 illustrates a partial perspective view of the frame members of FIG. 4 with a horizontal support illustrated for further context, with the rib linkage and horizontal member at their respective fully extended conditions.

Referring to FIG. 4, the rib linkage 120 is shown attached to a vertical support 116. A locking lever system, generally designated as reference numeral 124, generally comprises a longitudinal member or tube 126 with an end handle 128 to facilitate movement and manipulation of the lever member 126 by a user. The lever member 126 is connected to the rib linkage 120 and anchored to the vertical support 116 using a pivoting D-link 130. The rib linkage 120 comprises a first upright arm 132 pivotally connected to a second upright arm 134. An outsert tube 136 is provided over the first upright arm 132 to provide structural reinforcement. The lever member 126 is slidably positioned in a handle ring 138 which is pivotally connected to a slide collar 140 mounted on the first upright arm 132 and outsert tube 136 for sliding movement thereon. The lever member 126 includes two stops that can engage the handle ring 138 as the lever member 126 is moved in either direction. These stops limit the extent of movement for the lever member 126, and when either engages the handle ring 138, it will impart movement to the slide collar 140 to manipulate the first upright arm 132, as needed, in accordance with the present invention.

The first upright arm 132 is pivotally connected to an under leg pivot tube 142 via a pivot bracket 144. The under leg pivot tube 142 is mounted at the other end to the upright support 116 via a sliding collar 146. The first upright arm 132 is also pivotally connected to a first lift tube 148 through the slide collar 140. The first lift tube 148 is pivotally connected to a second lift tube 150 which is pivotally connected to the second upright arm 134 at a bracket 152. The second lift tube 150 is also connected to a center support tube 154 via a center support slide collar 156. The center support tube 154 is also pivotally connected to the second upright arm 134 at the bracket 152. A center hub cap 158 is mounted at the end of the second upright arm 134. A corresponding center hub support 160 is mounted at the end of the center support tube 154. The center hub cap 158 includes a locator pin 162. In use, when the rib linkage 120 is moved to its fully extended condition, the center hub cap 158 and the center hub support 160 move together to a locked position, wherein the locator pin 162 is received in the center hub support 160.

In operation, movement of the lever member 126 will influence movement of the first upright arm 132 and the first lift tube 148 via the slide collar 140. Movement of the first upright arm 132 will influence movement of the under leg pivot tube 142 and the second upright arm 134. Movement of the first lift tube 148 will influence movement of the second lift tube 150, which is also influenced, in part, by movement of the second upright arm 134 in effect by a scissoring action between the paired upright arms 132, 134 and the paired lift tubes 148, 150. Movement of the second upright arm 134 and the second lift tube 150 influence movement of the center support tube 154. The collective movement of the members of the rib linkage 120 causes the center hub cap 158 and the center hub support 160 to move together into locked engagement, which corresponds to the set-up and locked condition of the canopy structure 100.

Figure 6:
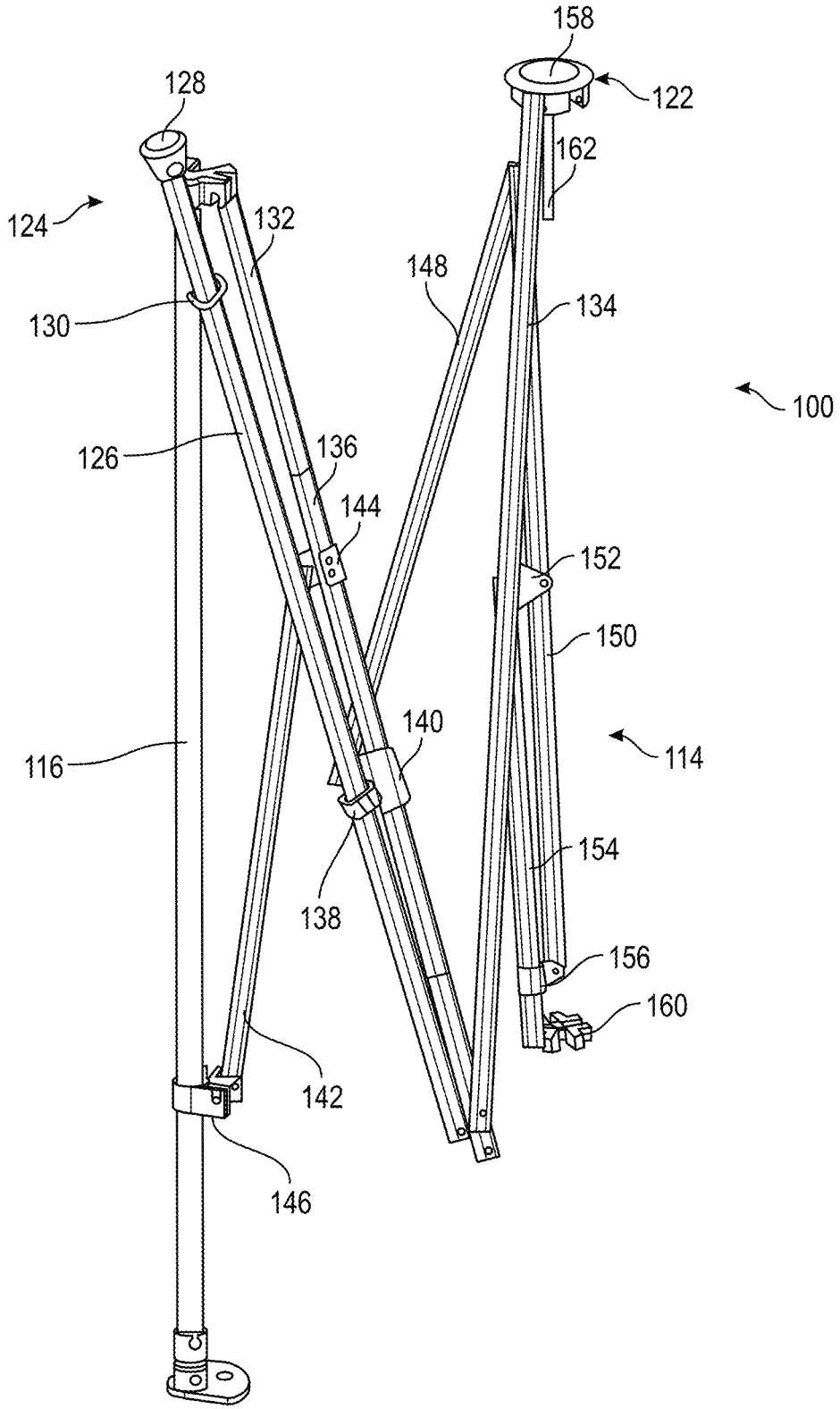
FIG. 6 illustrates the frame members of FIG. 4 in a collapsed and bundled condition of the canopy structure.

The process for opening the canopy frame 114 from its collapsed and bundled condition to a set-up condition is successively illustrated in FIGS. 6-9, with FIG. 6 illustrating the frame members in the collapsed condition of the canopy structure. FIG. 4 illustrates the frame members in the fully set-up condition of the canopy structure 100. The process steps for opening and setting up the canopy structure 100 are illustrated in FIGS. 20A-20C.

Figure 7:
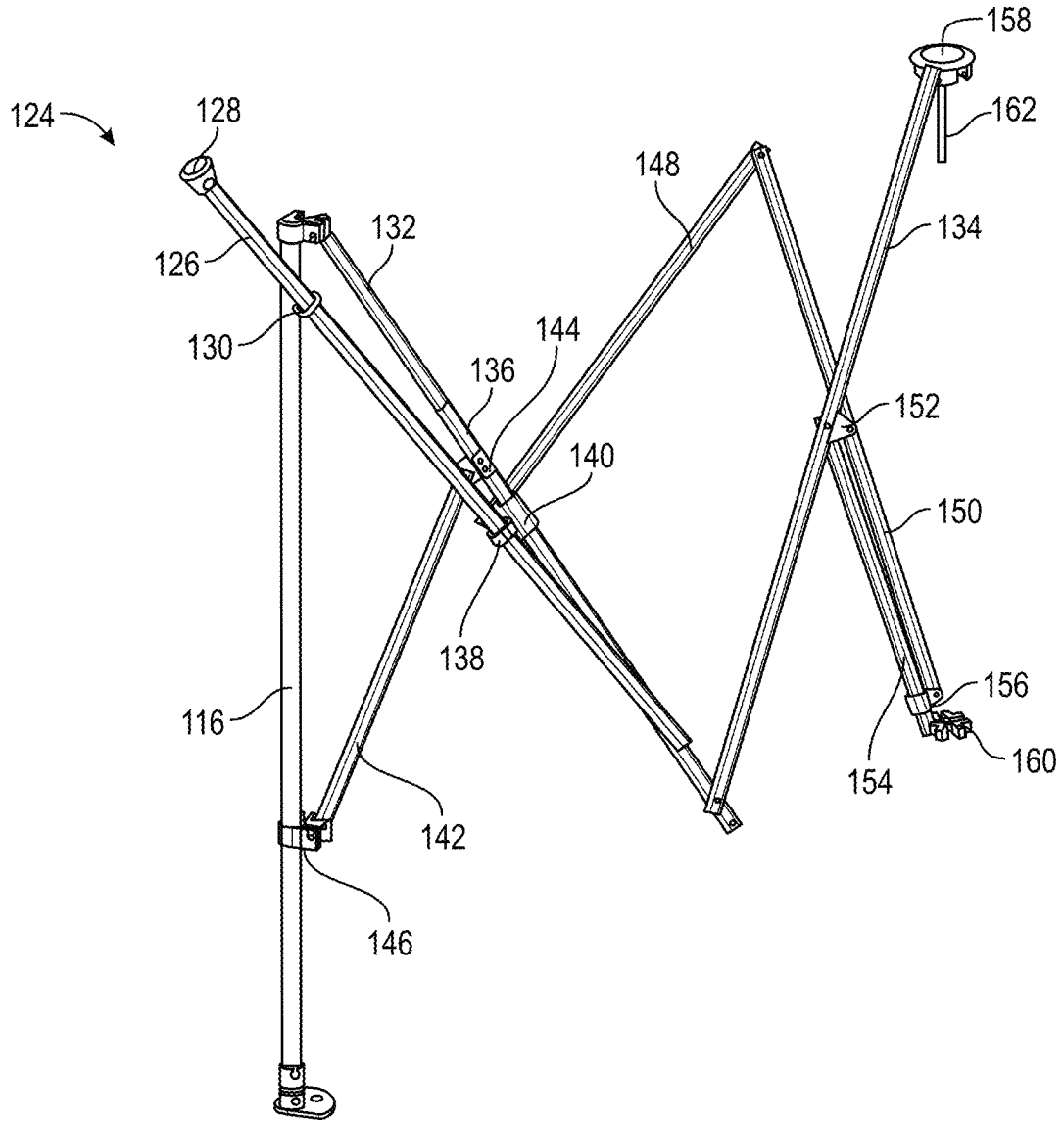
FIGS. 7-9 illustrate the frame members of FIG. 4 in successive conditions illustrative of moving the frame from the collapsed condition of FIG. 6 towards a set-up condition of FIG. 4.
Figure 8:
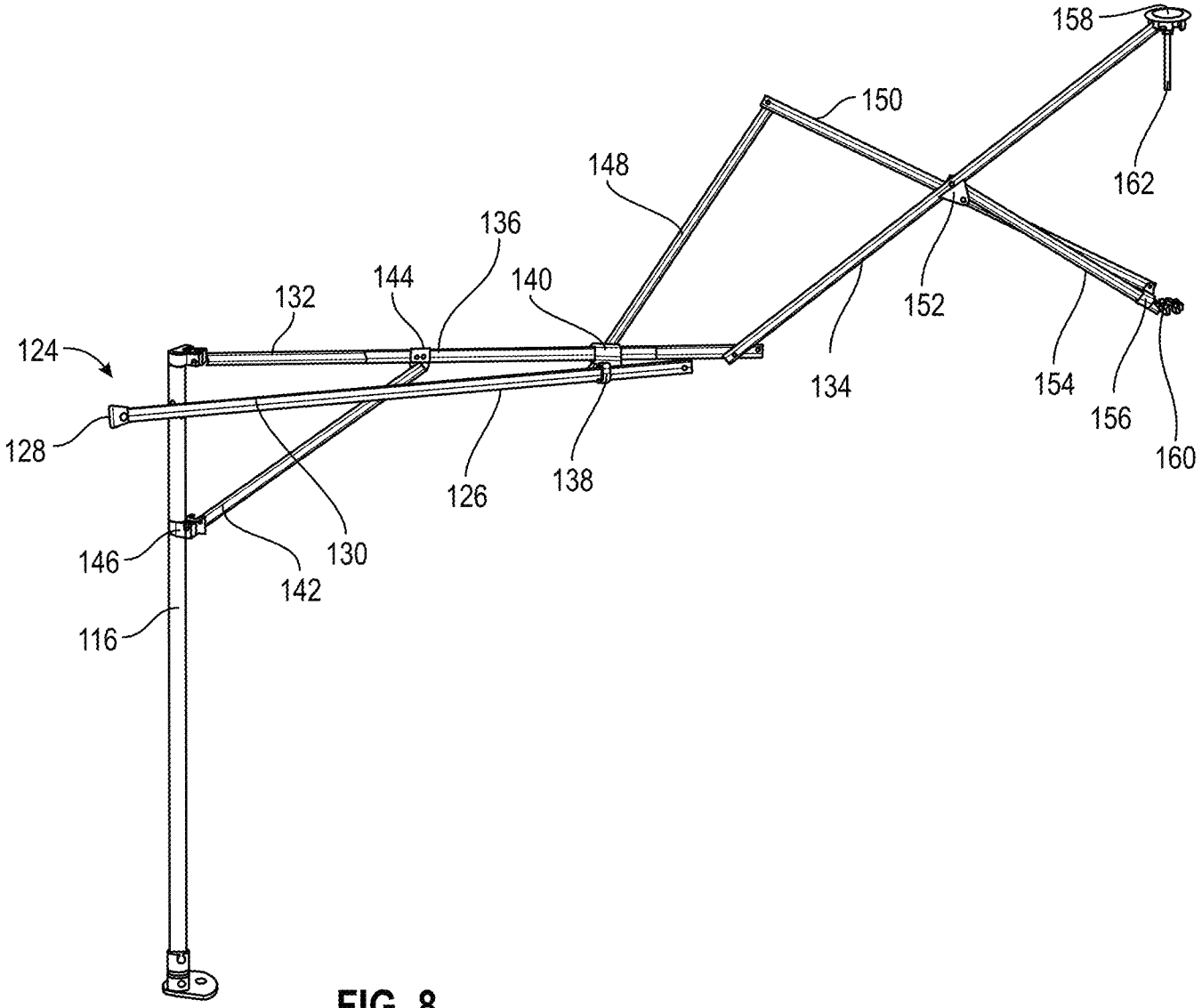
Figure 9:
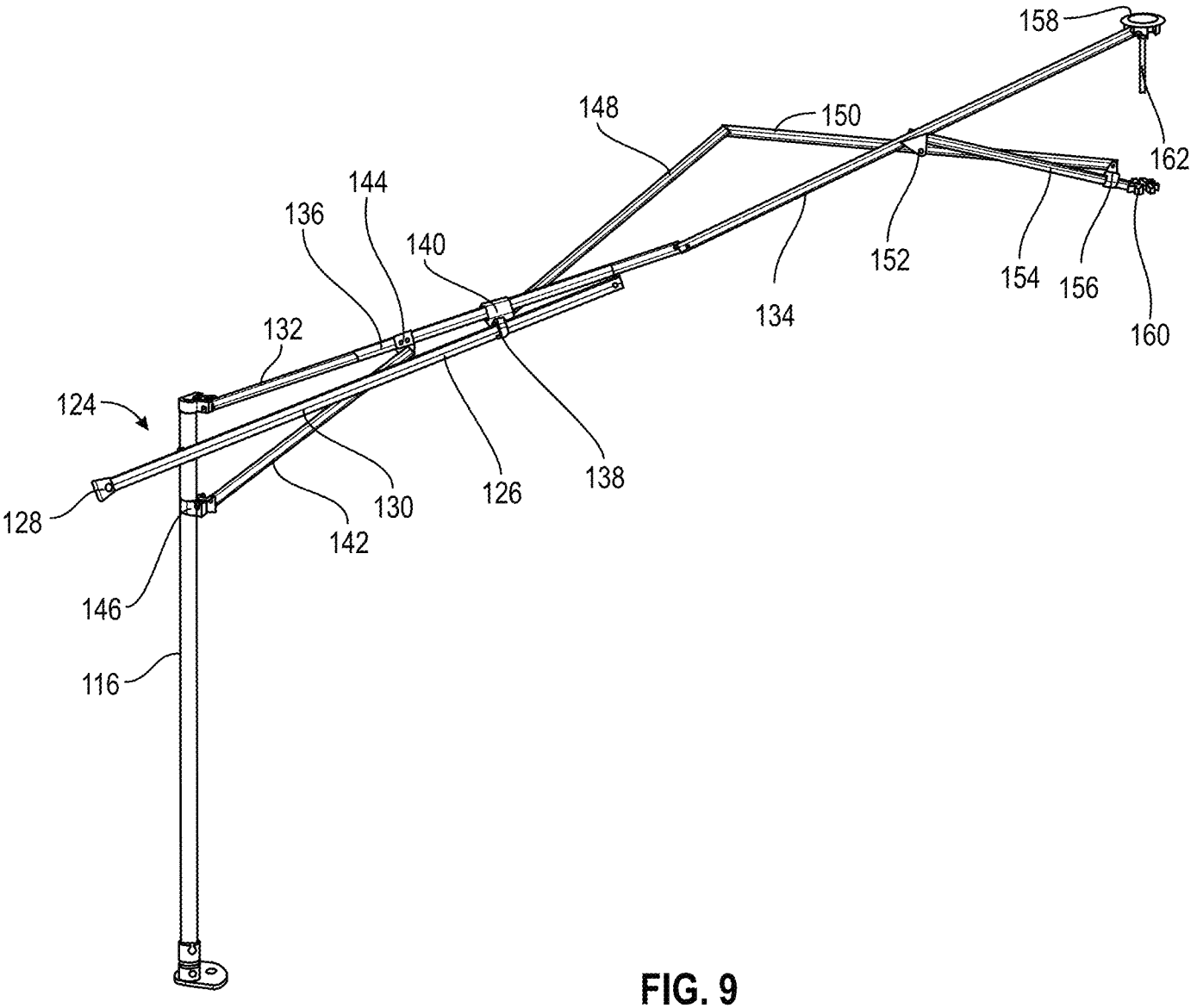
Figure 10:
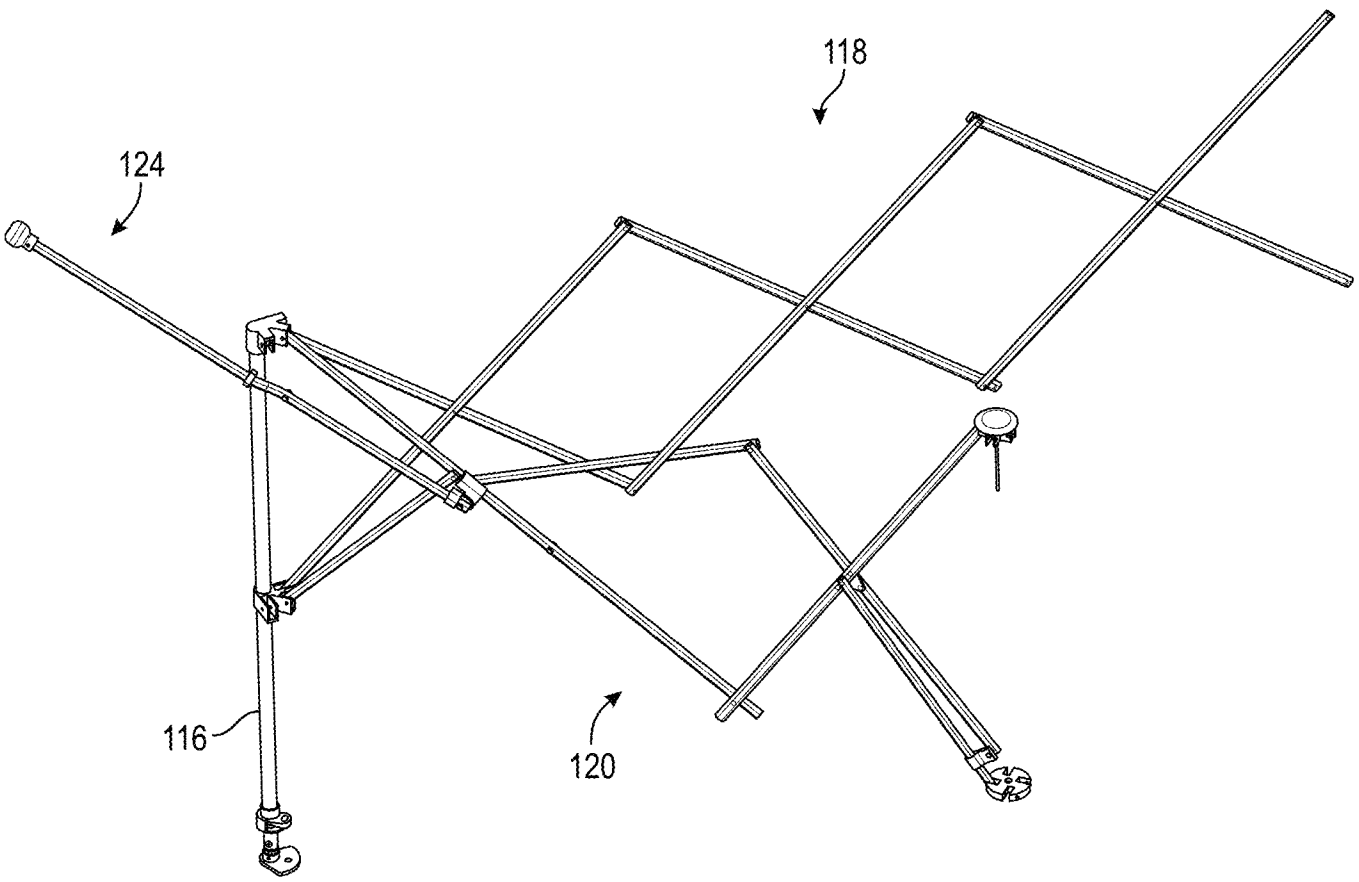
FIG. 10 illustrates a partial perspective view of the frame members of FIG. 4 with the horizontal support illustrated for further context relative to FIG. 5, with the rib linkage and horizontal support half extended, in the same manner as illustrated in FIG. 7.
Figure 20A:
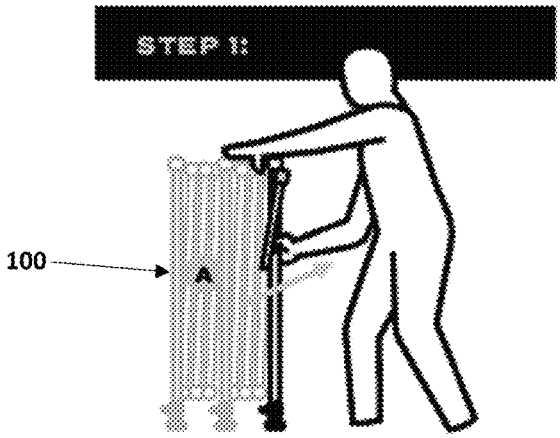
FIGS. 20A-20C illustrates set-up of the canopy structure in accordance with the present invention.
Figure 20B:
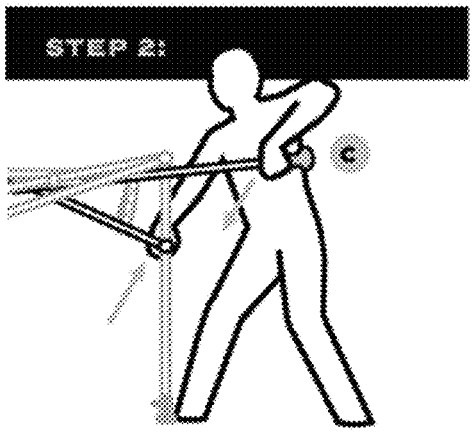
Figure 20C:
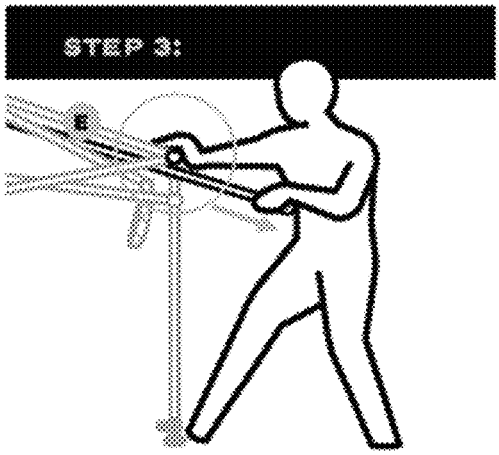

Referring to FIG. 20A, a user stands the collapsed canopy frame 114 upright on a level surface and gently pulls outwardly, expanding the frame 114 until it is about two-thirds open. As the frame 114 is expanding, it will generally go from the condition illustrated in FIG. 6 to the condition in FIG. 7. Referring now to FIG. 20B, the user grabs the lever member 126 and extend it outward from the frame 114. More particularly, the user pulls the lever member 126 upward and outward until the stop at the terminal end of the lever member 126 engages the handle ring 138. In preferred embodiments, the lever member 126 extends past the anchor of the D-link 130 on the upright support 116 by about 18 inches. Then, the user pushes downward on the lever member 126. More particularly, the user presses downward on the level lever member 126 to move it in a counterclockwise manner about the pivot point at the D-link 130. This movement will impart a force on the slide collar 140 which influences a counterclockwise upward lifting force onto the first upright arm 132 and a clockwise upward lifting force on the first lift tube 148. A scissoring action is created by the paired upright arms 132, 134 and the paired lift tubes 148, 150, as illustrated in FIGS. 7-9. Notably, as the first upright arm 132 moves upward in a counterclockwise manner, the second upright arm 134 moves upward in a clockwise manner. Likewise, as the first lift tube 148 moves upward in a clockwise manner, the second lift tube 150 moves upward in a counterclockwise manner.

Referring to FIGS. 7-9, the movement of the first upright arm 132 and the first lift tube 148 impart movement to the second upright arm 134 and the second lift tube 150. As the second upright arm 134 and the second lift tube 150 move, they impart movement on the center support tube 154 until it goes over center, as illustrated in FIG. 4. More particularly, the pushing on the lever member 126 will get the rib linkage 120 to the condition illustrated in FIG. 9. At this point, the user pulls the lever member 126 out and away from the center of the canopy structure 100 until the stop at the end engages the handle ring 138 and pulls on the slide collar 140. The force applied to the slide collar 140 pulls the end of the first lift tube 148 away from the center of the canopy structure 100, which, in turn, pulls on the second lift tube 150 so that the first lift tube 148 and the second lift tube 150 collectively pivot closer to a flat condition adjacent to the upright arm pairing 132, 134. This movement manipulates the center support tube 154 to its over-center position and brings the center hub cap 158 and center hub support 160 together. As shown in over-center condition, the center support tube 154 is at a slight upwards angle, indicating a locked position for the rib linkage 120. This position of the center support tube 154 coincides with the center hub cap 158 engaging the center hub support 160, as also shown in FIG. 4.

At the fully extended condition of the rib linkage 120, the first upright arm 132 and the second upright arm 134 are essentially coextensive, as illustrated in FIG. 4. The first lift tube 148 and the second lift tube 150, have a slight angled relationship to ensure that the rib linkage 120 can be easily collapsed when the center hub 122 is disengaged.

After the rib linkage 120 has been moved to its fully extended condition, as illustrated in FIG. 4, the lever member 126 is pushed inward toward the center of the canopy structure 100 until it engages a catch or detent (not shown), which will hold the lever member 126 in position during use of the canopy structure 100.

During set-up, as the lever member 126 is influencing movement of the first upright arm 132, the under leg pivot tube 142 will also begin to pivot upward in a clockwise direction. As it so moves, the terminal end mounted to the vertical support 116 via a slide collar 146 will slide up on the vertical support 116. In an alternate design of the present invention, a secondary locking mechanism (such as a spring-biased push button and detent) can be provided on the vertical support 116 to lock the slide collar 146 in place once it reaches a desire height-wise location on said vertical support 116. This secondary locking mechanism can assist the user in situations, for example, where the user's grip on the lever member 126 slips so that the frame 114 does not fully collapse. At the same time, the user can use a free hand to guide the corresponding extension of the horizontal supports 118 extending from the vertical support 116 to help extending the canopy frame 114 out to its set-up condition.

After the rib linkages 120 and horizontal supports 118 have been extended in this manner, the user can then adjust the vertical supports 116 to desired heights using known technology—namely telescoping members locked with spring-biased push buttons and detents.

With proper force and geometrical tweaks (such as a longer member hanging from the center of the ceiling), it is possible to use the first "lift" action of the lever member 126 during set-up of the canopy frame 114 to engage (and lock) the center hub support 160 to the center hub cap 158. This approach is similar to the "one push" technique of prior art devices, but instead capitalizes on the lever action from outside the canopy structure 100 instead of one's hand from inside and underneath the canopy structure 100. This technique would not lock the canopy frame 114 using anything "over-center", as the "lever-lock" does this sufficiently, but like the one-push technique, an additional lock could be integrated into the center hub assembly so that when the frame members are lifted relative to one another to the set-up condition of the canopy frame 114, the frame 114 would be locked into the opened and set-up condition. A downside here is that a user would still need to manually unlock the canopy frame 114 from underneath the canopy structure 100 (a la the "one-push" prior art technique) to disengage the additional lock in order to collapse the canopy structure 100.

Figure 19:
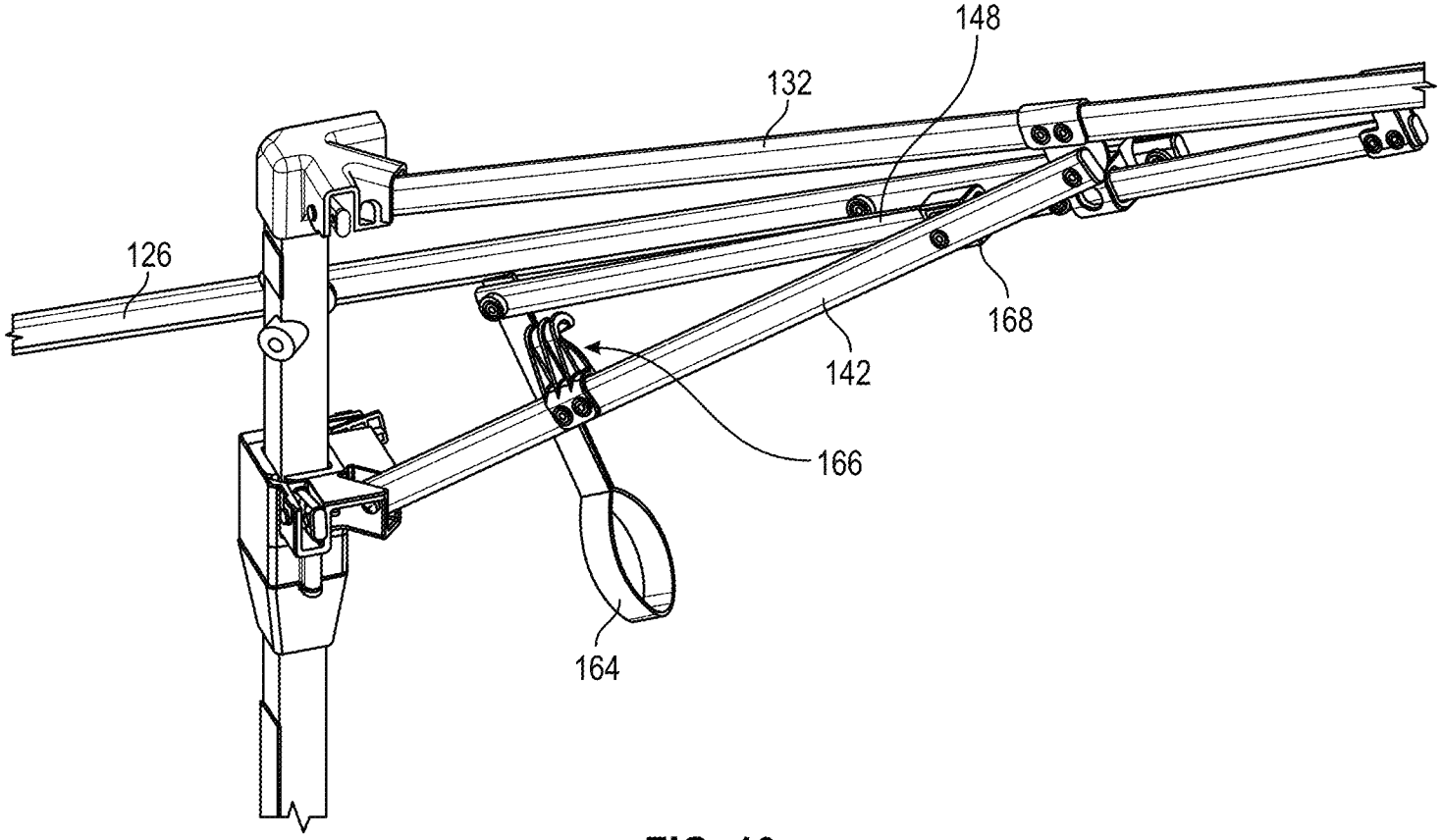
FIG. 19 illustrates a partial perspective view of a rib linkage and vertical support at one corner of a canopy structure with a locking system for the frame in accordance with another embodiment of the present invention.

With the embodiments described herein, "locking" of the canopy frame 114 is facilitated by an over-center linkage when the second "pull" operation is enacted on the lever—i.e., after the lift. (See, e.g., FIG. 20C). As such, the over-center linkage "lock" is not as positive and force pulling down on the linkage assembly may "unlock" it. This might occur, for example, by hanging wet towels, a lantern, or other weighted objects from the frame members, such as up near the center hub 122, which is not uncommon. As discussed, a single collar lock on the vertical frame support 116 that includes the lever member 126 acts as a safety "lock" for the canopy structure 100. In alternate embodiments, an additional lock assembly can be provided with the lever linkage system 124, preferably within arm's reach from outside the canopy structure 100. Effectively, set-up of the canopy structure 100 comprises a 3-step operation: 1. Lift; 2. Lock; 3. then optionally "safety lock" if one wants to hang items from the hub area links. Referring to FIG. 19, an additional safety lock assembly is illustrated that will secure the canopy frame 114 from collapsing under weight applied to the frame members. As shown, a strap 164 is attached to the end of the first lift tube 148 and in operation is used to pull the end of the first lift tube 148 down and into engagement with a hook 166 mounted on the under leg pivot tube 142 directly positioned below it. This secures the linkage mechanism from disengaging even when weight is hung from the center hub of the canopy frame 114 (which would otherwise cause the canopy center to come dislodged from the over-center state).

Figure 21A:
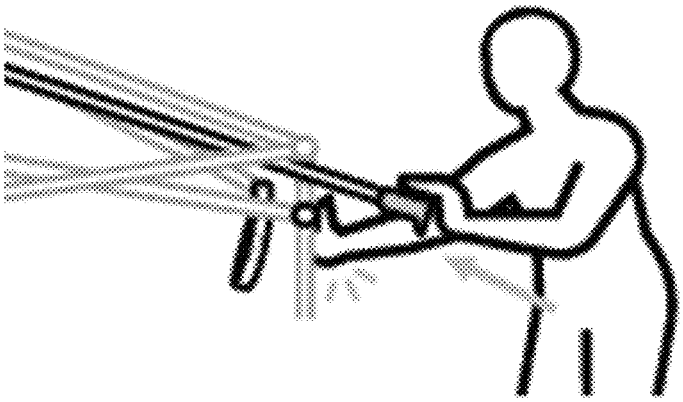
FIGS. 21A-21B illustrates collapsing of the canopy structure in accordance with the present invention.
Figure 21B:
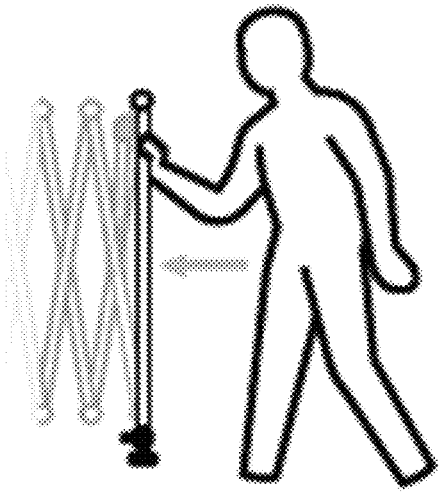

To collapse the set-up canopy structure 100, the user starts with the rib linkages 120 as shown in FIG. 4. Referring to FIG. 21A, the user first pushes the lever member 126 towards the center hub 122 of the canopy structure 100 until a second stop located midway on the lever member 126 engages the handle ring 138, which moves the slide collar 140. The movement of the lever member 126 in this step is about 1-2 inches and generally comprises a "hard tap". The movement of the slide collar 140 moves the first lift tube 148 to raise the pivot point between the first and second lift tubes 148, 150 upwards, which pops the center hub 122 out of over-center engagement. Then, under the influence of gravity, the rib linkage members 120 begin to collapse and pivot together. At the same time, the user can pull the lever member 126 out and away from the center of the canopy structure 100 and push upwards (clockwise) on the lever member 126 to aid and facilitate the collapsing process. This motion, along with gravity, will help brings the vertical supports 116 at the four corners of the canopy structure 100 together. Referring to FIG. 21B, the user, from a single corner of the canopy structure 100, can push the canopy frame 114 inward to fully collapse the canopy structure 100 for storage. If the design utilizes the secondary locking mechanism, that should be disengaged before using the lever member 126 to pop the center hub 122 out of engagement.

In testing, the present invention facilitates and speeds up the set-up process while eliminating the safety concerns associated with prior art designs. For example, the prior art one-push center hub design (current marketplace) takes about 20 seconds for each of the set-up and collapse operations and is decidedly more physically demanding and dangerous to undertake. By comparison, the locking lever design of the present invention takes about 9 seconds to set-up and about 7 seconds to collapse. (None of these measurements includes the step of adjusting the vertical supports or putting the collapsed canopy into a storage bag, and the like.)

A second embodiment of the present invention is illustrated in FIGS. 11-18. This embodiment operates in a similar fashion in terms of how the various members of the rib linkage 120 influence one another to move the rib linkage 120 from the collapsed condition to the fully extended condition and locks the rib linkage 120 in the set-up condition until the lever member 126 is used to disengage the center hub 122 for collapsing. In general, this second embodiment of the canopy structure 100 modifies aspects of the individual linkage members, as well as the pivotal and sliding connections of said linkage members.

Figure 17:
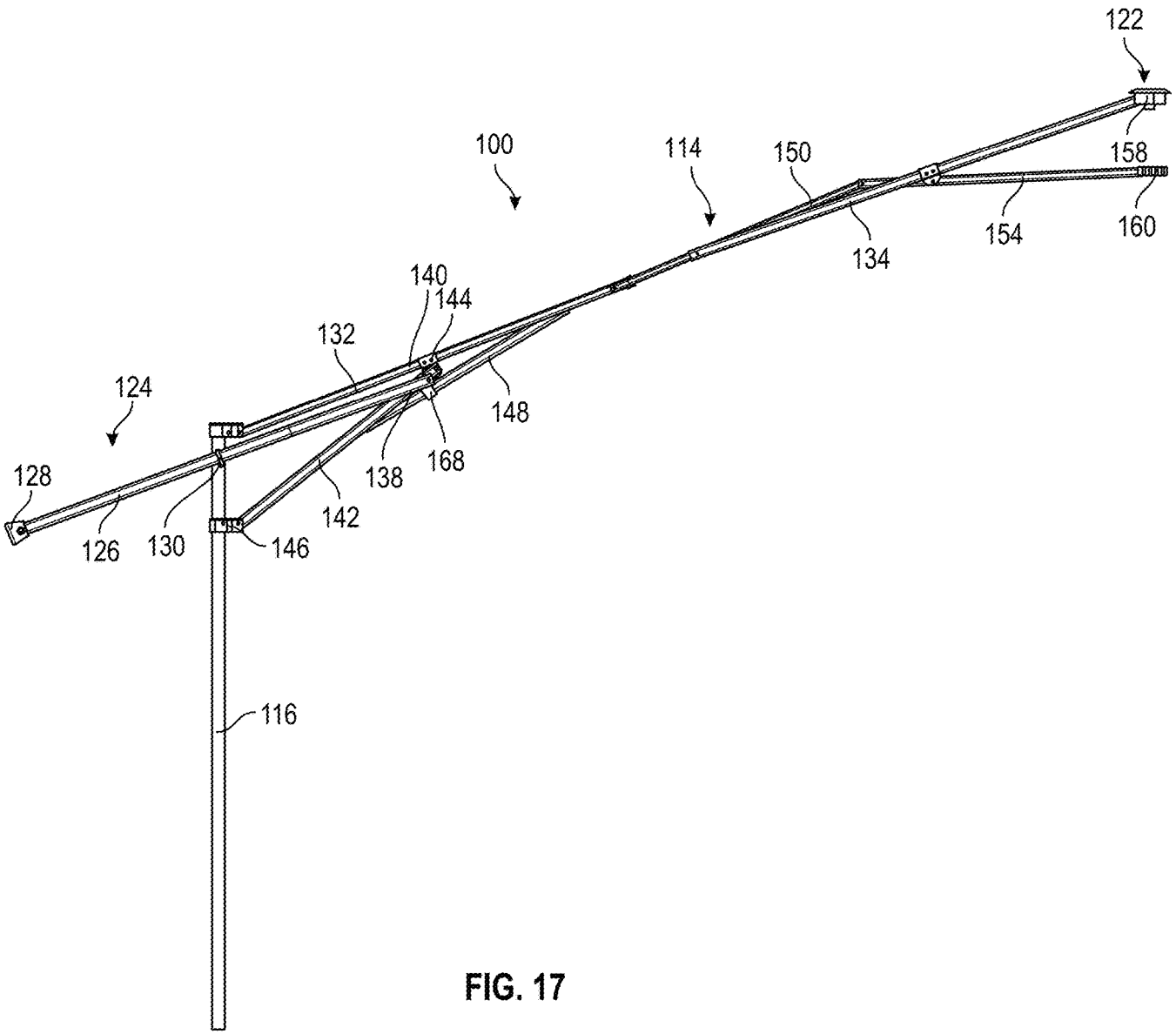

Referring to FIGS. 11-18, the first lift tube 148, second lift tube 150, and center support tube 154 are pivotally linked together in series, with the center support tube 154 being pivotally connected to the second upright arm 134, the second lift tube 150 being pivotally connected to the first upright arm 132, and the first lift tube 148 being pivotally connected to the under leg pivot tube 142 via a slide collar 168 (pivotally mounted on the under leg pivot tube 142 and through which the first lift arm 148 is adapted for sliding movement). The lever member 126 is also pivotally connected to the under leg pivot tube 142 via a slide collar 138 such that downward motion on the lever member 126 will lift the under leg pivot tube 142 upwards, with one end sliding up the vertical support 116 and the other side pushing upwards on the first upright arm 132 and the first lift arm 148. These motions impart a scissoring motion at the central end of the rib linkage 120 so that the center hub cap 158 and the center hub support 160 move together into engagement, as shown in FIG. 17.

Figure 11:
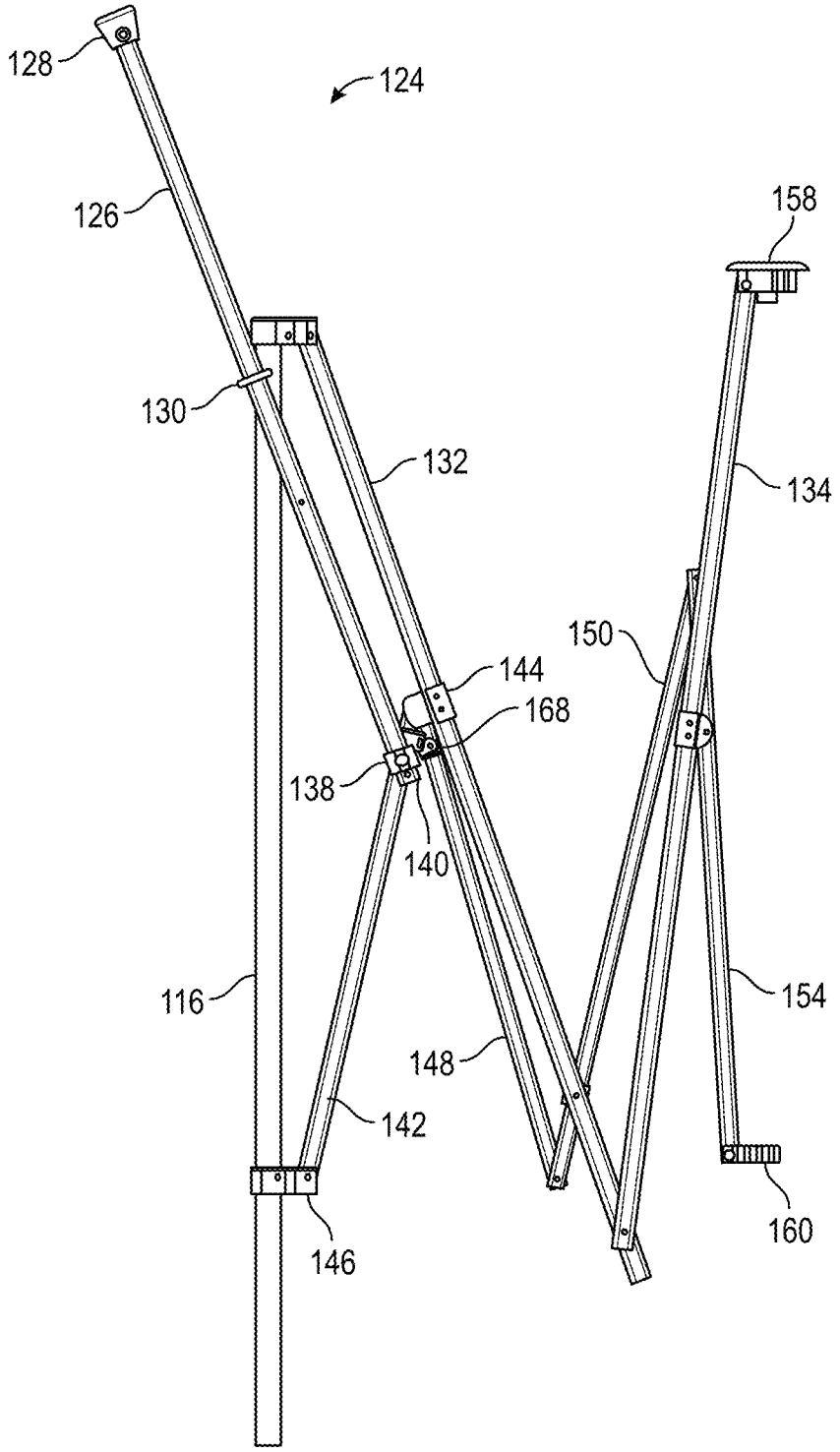
FIGS. 11-18 illustrate partial perspective views of a rib linkage and vertical support at one corner of a canopy structure with a locking lever member in accordance with a second embodiment of the present invention, with the rib linkage at a collapsed condition in FIG. 11 and the rib linkage at a fully extended condition in FIGS. 17-18.
Figure 12:
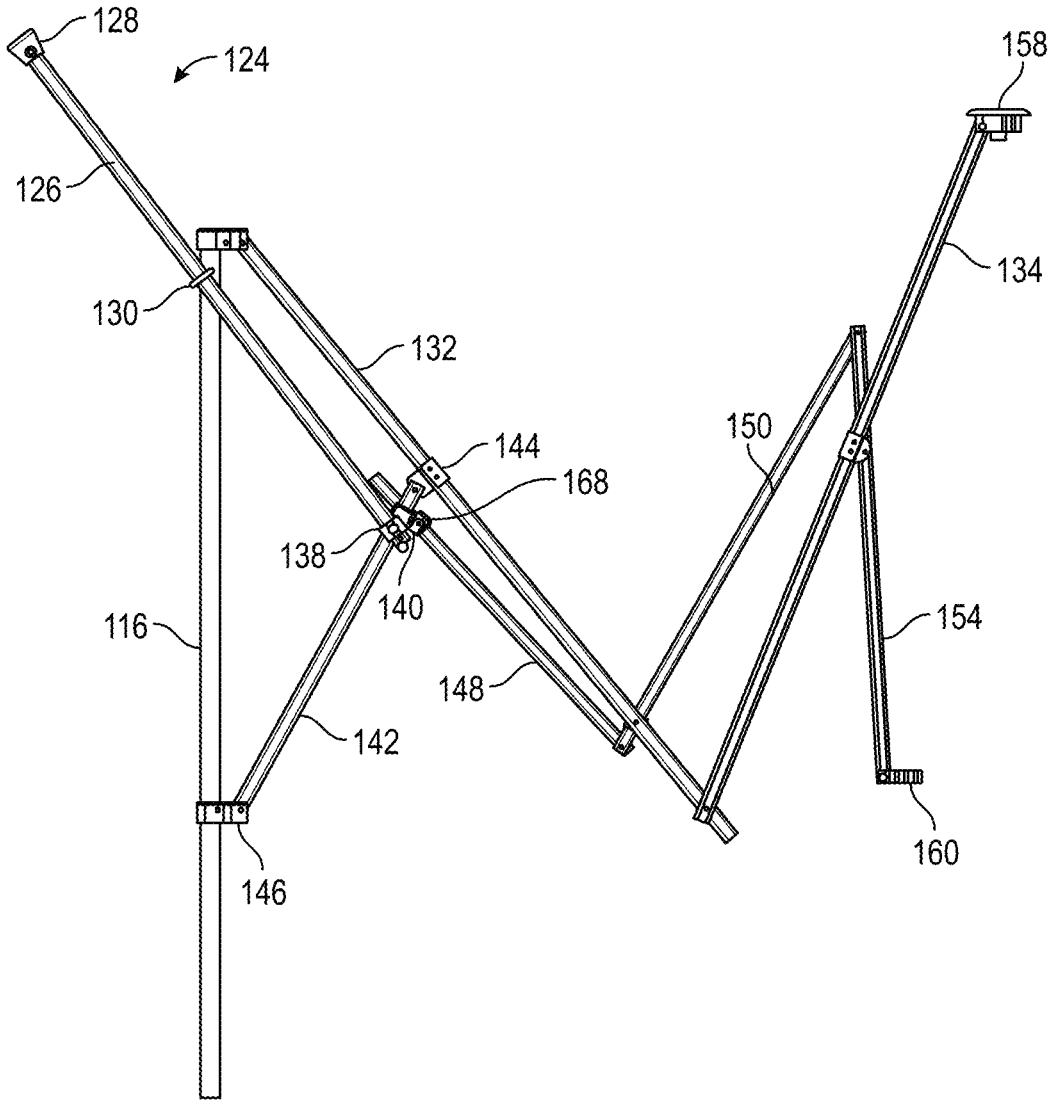
Figure 13:
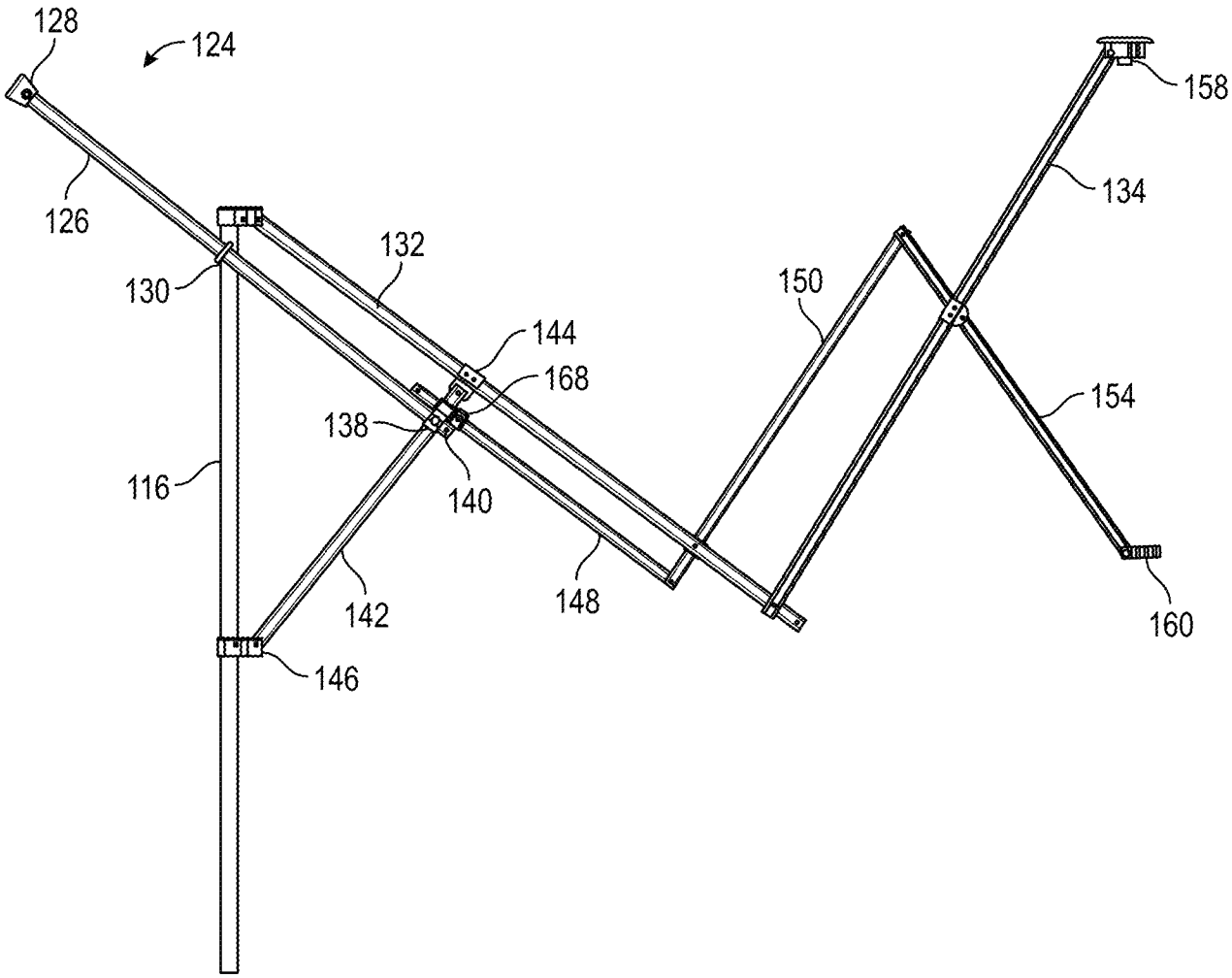
Figure 14:
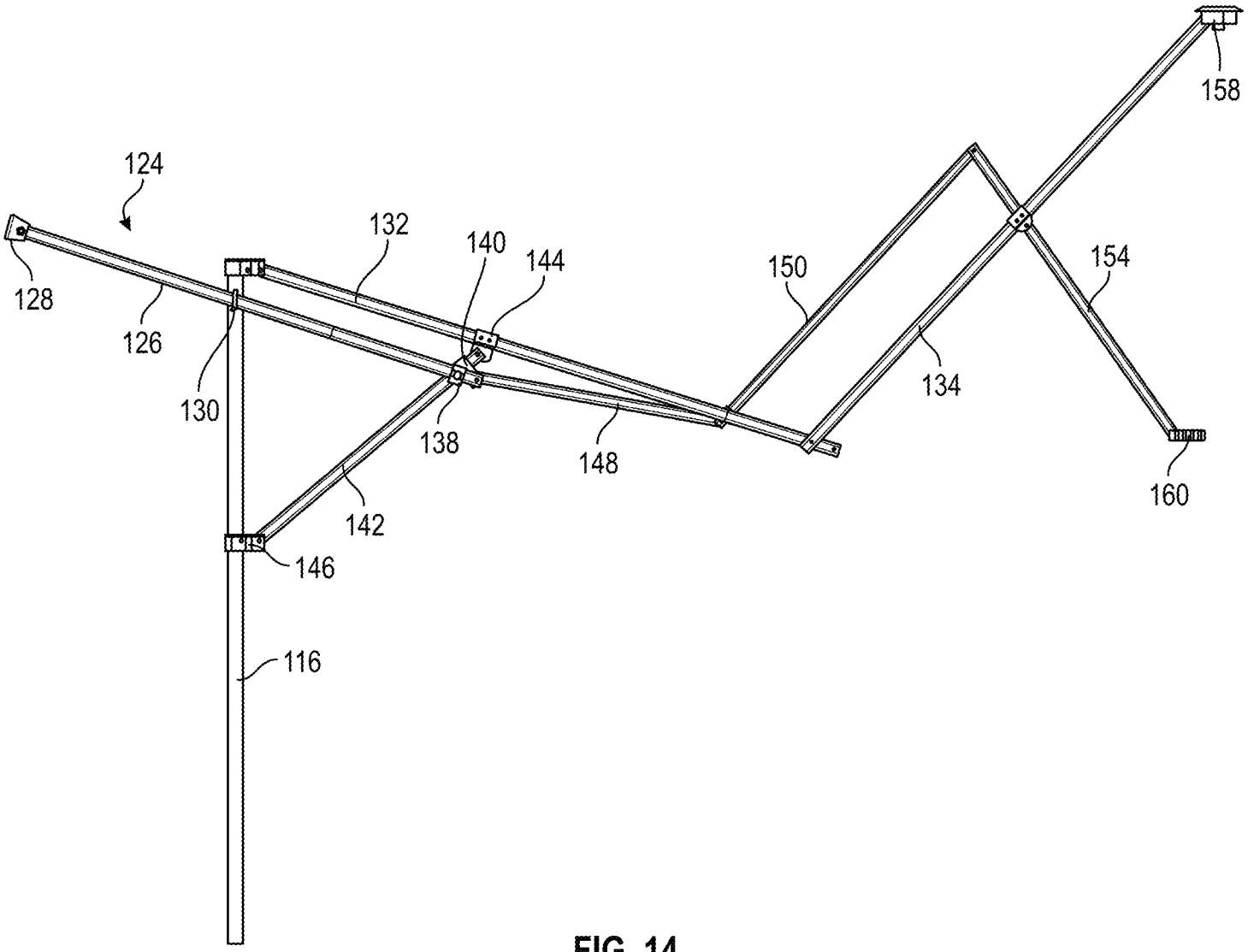
Figure 15:
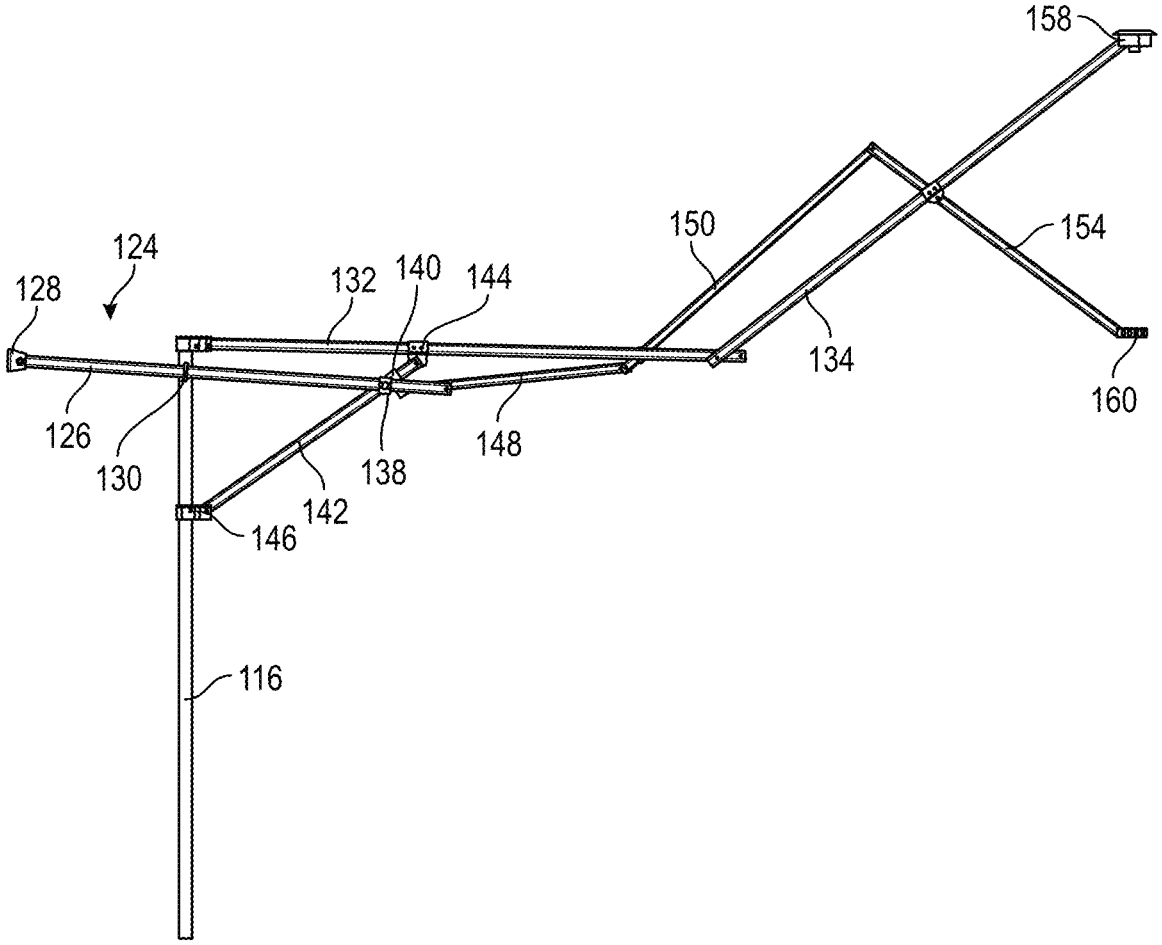
Figure 16:
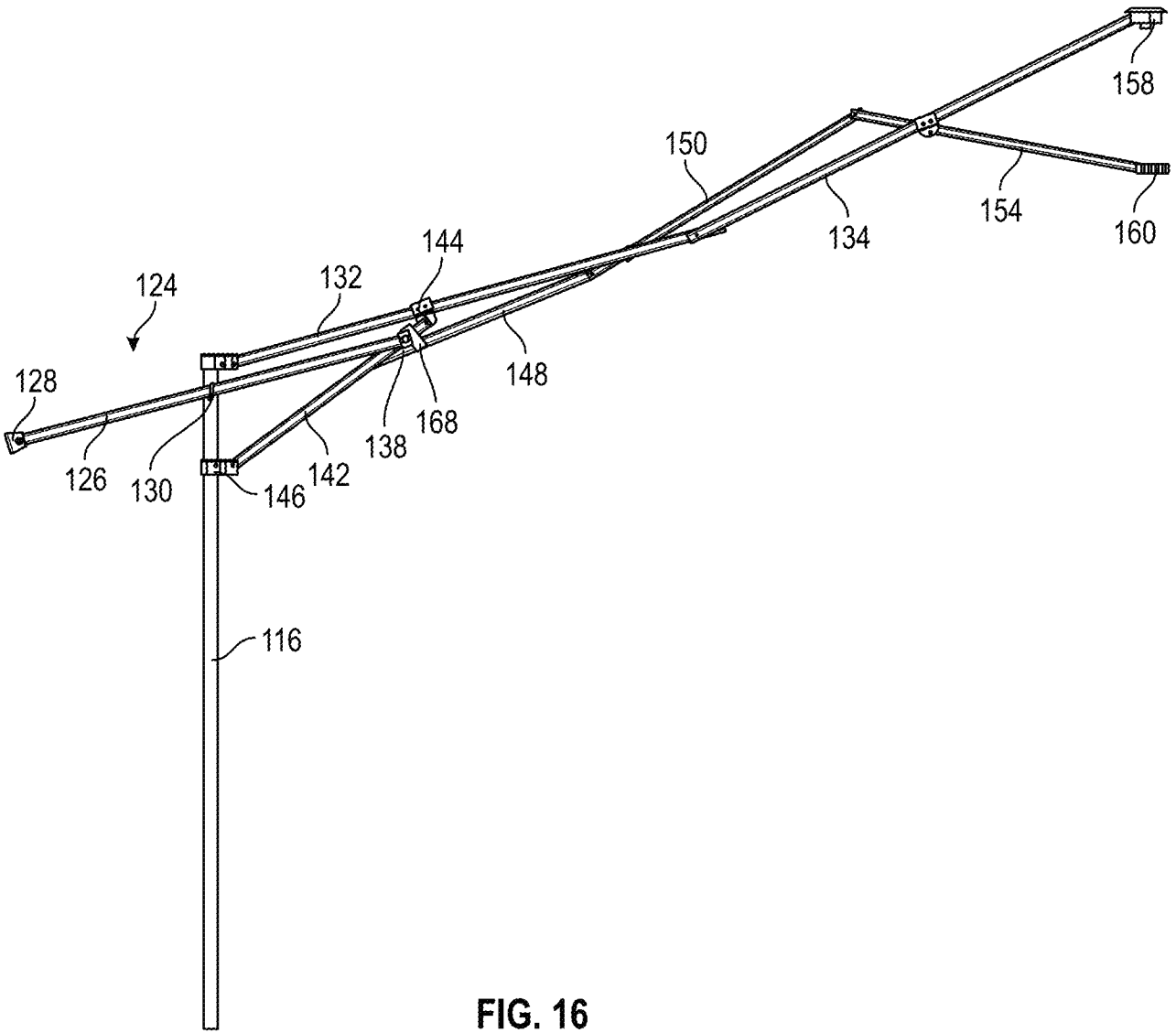

Referring to FIG. 11, the lever member 126 is connected to the under leg pivot tube 142 via the slide collar 138, which can be a handle ring as in the first embodiment. The slide collar 138 is mounted on a slide collar 140, which connects to the under leg pivot tube 142 between the lever member 126 and the first lift tube 148. The end of the under leg pivot tube 142 is also pivotally connected to the first upright arm 132 via a pivot bracket 144.

Figure 18:
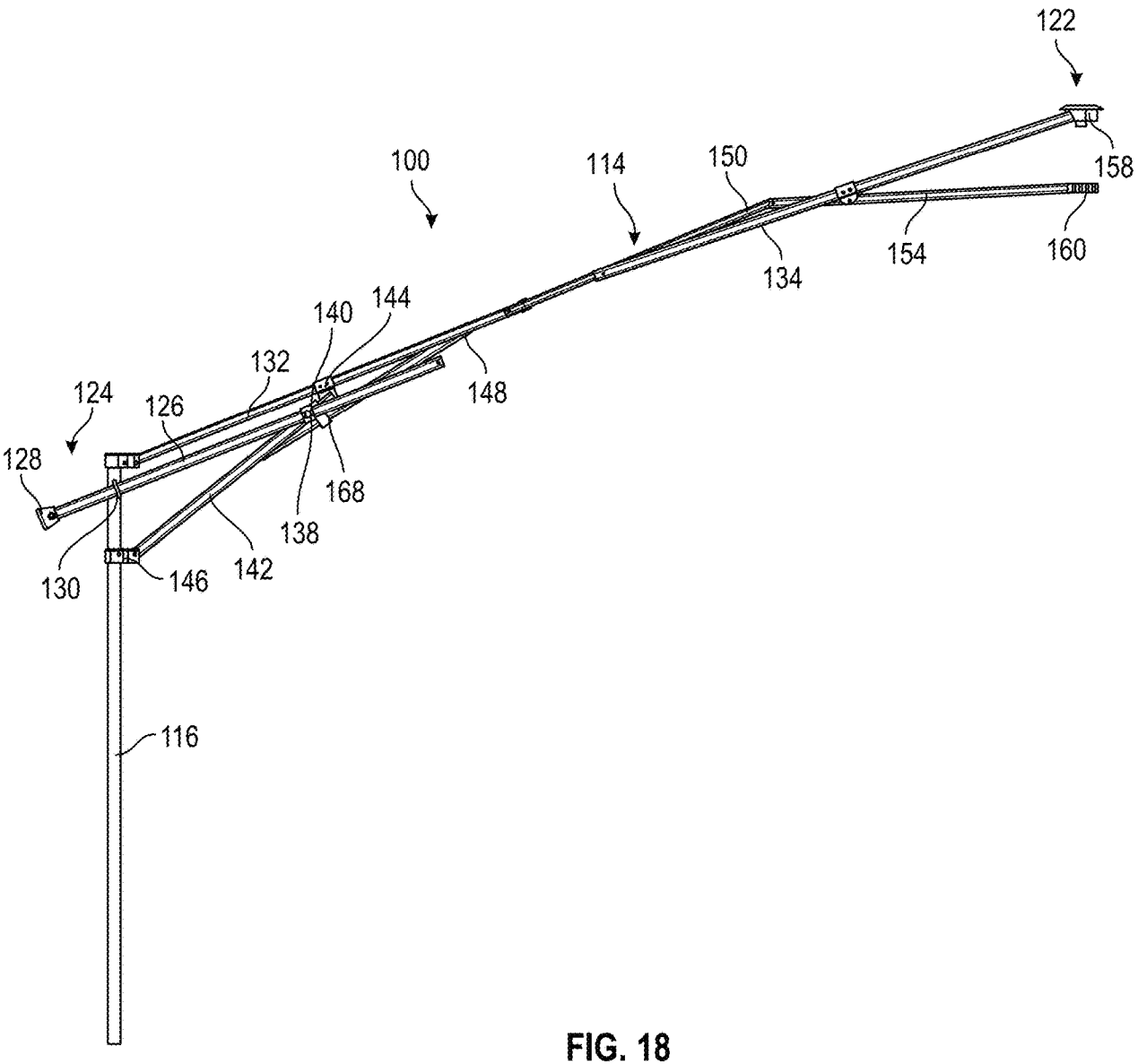

FIG. 17 shows the rib linkage 120 in a fully extended condition associated with the set-up condition of the canopy structure 100. FIG. 18 also illustrates the canopy structure 100 in its set-up condition, but with the lever member 126 pushed inwards to its storage position (held by a catch or detent (not shown)). When collapsing the canopy structure 100, the lever member 126 is pulled outwards to the position shown in FIG. 17, where pushing upward on the lever member 126 will help disengage the center hub 122 for collapsing the frame 114 with the assistance of gravity and continued upward pushing on the lever member 126.

The foregoing description of embodiments of the invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated.

What is claimed is:

1. A portable and collapsible canopy structure comprising:

a frame assembly being movable between a set-up condition and a collapsed condition, said frame assembly comprising:

a plurality of vertical supports defining a perimeter for the frame assembly in the set-up condition;

a plurality of scissoring horizontal supports each pivotally connected to and extending between an adjacent pair of vertical supports around the perimeter of the frame assembly and adapted for movement between an extended condition corresponding to the set-up condition of the frame assembly and a retracted condition corresponding to the collapsed condition of the frame assembly;

a plurality of rib linkages, each pivotally connected to a respective vertical support and extending from said vertical support towards a central hub where the plurality of rib linkages meet, each said rib linkage being adapted for movement between an extended condition corresponding to the set-up condition of the frame assembly and a retracted condition corresponding to the collapsed condition of the frame assembly; and a lever member pivotally connected to one of the plurality of rib linkages for facilitating movement of said rib linkage between the extended and retracted conditions, wherein the lever member also locks the frame once in its set-up condition; and a fabric cover, configured to cover at least a portion of the frame assembly.

2. The portable and collapsible canopy structure according to claim 1, wherein the rib linkage associated with the lever member comprises:

a first upright arm pivotally connected to the vertical support associated with said rib linkage;

a second upright arm pivotally connected to the first upright arm, wherein a center hub cap is mounted at a distal end of said second upright arm;

a first lift tube pivotally connected to the first upright arm;

a second lift tube pivotally connected to the first lift tube and to the second upright arm; and a center support tube pivotally connected between the second upright arm and the second lift tube, wherein a center hub support is mounted at a distal end of said center support tube;

wherein the lever member is pivotally connected to the rib linkage such that pivoting movement of the lever member influences movement of the first upright arm and first lift tube, which influences movement of the second upright arm and second lift tube, which influences movement of the center support tube, all of which move the center hub cap and the center hub support between an engaged condition corresponding to the set-up condition of the canopy frame assembly and a disengaged condition whereby the frame assembly can be moved to its collapsed condition.

3. The portable and collapsible canopy structure according to claim 2, wherein the rib linkage further comprises an under leg pivot tube pivotally connected between the vertical support associated with the rib linkage and at least one of the first upright arm and the first lift tube.

4. The portable and collapsible canopy structure according to claim 3, further comprising a rib linkage locking assembly for securing the rib linkage in its extended condition, said rib linkage locking assembly comprising a hook provided on the under leg pivot tube adapted to receive the first lift tube when the rib linkage is in its extended condition.

5. The portable and collapsible canopy structure according to claim 4, wherein the rib linkage locking assembly further comprises a strap positioned at a terminal end of the first lift tube to facilitate movement of the first lift tube into and out of engagement with the hook.

6. The portable and collapsible canopy structure according to claim 1, wherein the lever member is pivotally anchored to the vertical support associated with the rib linkage to which the lever member is connected.

7. The portable and collapsible canopy structure according to claim 1, further comprising a secondary locking mechanism securing the rib linkage associated with the lever member to the vertical support to which said rib linkage is connected when said rib linkage is in its extended condition.

8. A portable and collapsible canopy structure comprising:

a frame assembly being movable between a set-up condition and a collapsed condition, wherein said frame assembly comprises:

a plurality of vertical supports defining a perimeter for the frame assembly in the set-up condition;

a plurality of scissoring horizontal supports each pivotally connected to and extending between an adjacent pair of vertical supports around the perimeter of the frame assembly and adapted for movement between an extended condition corresponding to the set-up condition of the frame assembly and a retracted condition corresponding to the collapsed condition of the frame assembly; and a plurality of rib linkages, each pivotally connected to a respective vertical support and extending from said vertical support towards a central hub where the plurality of rib linkages meet, each said rib linkage being adapted for movement between an extended condition corresponding to the set-up condition of the frame assembly and a retracted condition corresponding to the collapsed condition of the frame assembly;

a fabric cover, configured to cover at least a portion of the frame assembly; and a lever member pivotally connected to the frame assembly via one of the rib linkages for assisting a user in moving the frame assembly to its set-up condition and locking the frame assembly once in said set-up condition;

wherein the rib linkage associated with the lever member comprises:

a first upright arm pivotally connected to the vertical support associated with said rib linkage;

a second upright arm pivotally connected to the first upright arm, wherein a center hub cap is mounted at a distal end of said second upright arm;

a first lift tube pivotally connected to the first upright arm;

a second lift tube pivotally connected to the first lift tube and to the second upright arm; and a center support tube pivotally connected between the second upright arm and the second lift tube, wherein a center hub support is mounted at a distal end of said center support tube;

wherein the lever member is pivotally connected to the rib linkage such that pivoting movement of the lever member influences movement of the first upright arm and first lift tube, which influences movement of the second upright arm and second lift tube, which influences movement of the center support tube, all of which move the center hub cap and the center hub support between an engaged condition corresponding to the set-up condition of the canopy frame assembly and a disengaged condition whereby the frame assembly can be moved to its collapsed condition, wherein said canopy structure defines a set-up footprint which comprises at least one corner, wherein the lever member is pivotally connected to the frame assembly at one corner of the canopy structure so that a user can move the frame assembly to its set-up condition from said one corner of the canopy structure, wherein a user can access and use the lever member to assist with set-up and collapsing of the canopy structure from a position outside the footprint of the canopy structure.

9. The portable and collapsible canopy structure according to claim 8, wherein the lever member can further be used to unlock the frame assembly from the set-up condition and assist in moving the frame to its collapsed condition.

10. The portable and collapsible canopy structure according to claim 8, wherein the lever member is pivotally anchored to the vertical support associated with the rib linkage to which the lever member is connected.

11. The portable and collapsible canopy structure according to claim 8, further comprising a secondary locking mechanism to maintain the canopy structure in its set-up condition.

12. The portable and collapsible canopy structure according to claim 11, wherein the secondary locking mechanism comprises a spring-biased button and detent system provided on at least one vertical support member, said spring-biased button engaging said detent system once the frame assembly is in its set-up condition.

13. The portable and collapsible canopy structure according to claim 11, wherein the rib linkage further comprises an under leg pivot tube pivotally connected between the vertical support associated with the rib linkage and at least one of the first upright arm and the first lift tube; and wherein the secondary locking mechanism comprises a hook provided on the under leg pivot tube adapted to receive the first lift tube when the rib linkage is in its extended condition.

14. The portable and collapsible canopy structure according to claim 13, wherein the secondary locking assembly further comprises a strap positioned at a terminal end of the first lift tube to facilitate movement of the first lift tube into and out of engagement with the hook.

* * * * *